US008459890B2

(12) United States Patent
Komatsuda et al.

(10) Patent No.: US 8,459,890 B2
(45) Date of Patent: Jun. 11, 2013

(54) CYLINDRICAL COSMETIC CONTAINER

(75) Inventors: Kiyoshi Komatsuda, Tokyo (JP); Satoru Naramoto, Tokyo (JP)

(73) Assignee: Hidan Co., Ltd. (JP)

( * ) Notice: Subject to any disclaimer, the term of this patent is extended or adjusted under 35 U.S.C. 154(b) by 355 days.

(21) Appl. No.: 12/630,944

(22) Filed: Dec. 4, 2009

(65) Prior Publication Data

US 2010/0290827 A1 Nov. 18, 2010

(30) Foreign Application Priority Data

May 18, 2009 (JP) ..... 2009-119442
Dec. 1, 2009 (JP) ..... 2009-273677

(51) Int. Cl.
*A45D 40/24* (2006.01)

(52) U.S. Cl.
USPC ..... 401/78; 401/86; 132/318

(58) Field of Classification Search
USPC ... 401/78, 88, 49, 59, 98, 75, 77, 68; 132/317
See application file for complete search history.

(56) References Cited

U.S. PATENT DOCUMENTS 4,603,989 A * 8/1986 Ackerman et al. ..... 401/78
4,972,251 A * 11/1990 Lehrer ..... 257/633
6,035,866 A * 3/2000 Seneco et al. ..... 132/318

* cited by examiner

*Primary Examiner* — David Walczak
*Assistant Examiner* — Jennifer C Chiang
(74) *Attorney, Agent, or Firm* — Gerald E. Hespos; Michael J. Porco; Matthew T. Hespos

(57) ABSTRACT

A tubular cosmetic container has a cap (10) fit outside a container body (1), a cap body (11), an inner cap (12) fit inside the cap (10), and a to-be-covered portion. The inner cap (12) is formed with a first protrusion (12*b*) located at a halfway covering posture during the course of covering the container body (1) from the halfway covering posture through an immediately preceding covering posture to a fully covering posture and applying a first slide resistance by being pressed into sliding contact with the container body (1), and a second protrusion (12*c*) located at the immediately preceding covering posture of covering the container body (1) and applying a second slide resistance larger than the first slide resistance by being pressed into sliding contact with the upper end of the container body.

19 Claims, 24 Drawing Sheets

CYLINDRICAL COSMETIC CONTAINER

BACKGROUND OF THE INVENTION

1. Field of the Invention

This disclosure relates to a tubular container for storing a cylindrical (stick-shaped) cosmetic such as a lipstick.

2. Description of the Related Art

JP-B-3153992 discloses a cylindrical cosmetic container with a tubular body that has an open upper end for receiving a cylindrical cosmetic. A cap is fit on the open upper end of the body of the cylindrical cosmetic container to cover the cylindrical cosmetic stored therein. A thick-walled portion is formed on an inner part of the cap and a convex rib is formed on an outer circumferential surface of the upper end of the container body to increase stability when the tubular cosmetic container body is covered. However, a motion resistance occurs as the thick-walled portion is moved over the convex rib. The motion resistance can be interpreted as indicating the completely covered condition, even though the cap is not mounted completely on the outer surface of the upper end of the body.

The upper end of the container body is exposed when the cap is detached, and the convex rib on the outer circumferential surface of the exposed upper end of the container body also is visually recognizable. A quality of appearance thus is lost. In addition, grime, such as the cosmetic in itself, easily accumulates at a rising edge of the convex rib because the convex rib projects toward the outer circumferential surface. Grime is difficult to remove and the accumulated grime deteriorates the quality of the appearance of the cosmetic container and the cosmetic in itself. The present disclosure solves the problems as well as other problems and is able to achieve various advantages.

SUMMARY OF THE INVENTION

The present invention has been made for the purpose of solving the above-described problems in view of the circumstances above. A first exemplary aspect of the disclosure provides a tubular cosmetic container that includes a container body and a tubular-topped cap. The container body houses a cylindrical cosmetic. The cap is fit outside the container body and covers a to-be-covered portion at an upper side of the container body. A first resistive portion is formed on an inner peripheral surface of the cap. A first slide resistance occurs as the to-be-covered portion is pressed into sliding contact with the first resistive portion from a halfway covering posture to at least an immediately preceding covering posture while the to-be-covered portion is being covered by the cap. The halfway covering posture is followed by the immediately preceding covering posture, and the immediately preceding covering posture is followed by a fully covering posture. A second resistive portion also is formed on the inner peripheral surface of the cap. A second slide resistance that is greater than the first slide resistance occurs as the to-be-covered portion is pressed into sliding contact with the second resistive portion from the immediately preceding covering posture to the fully covering posture while the to-be-covered portion is being covered by the cap.

A second exemplary aspect of the disclosure provides the cosmetic container according to the first exemplary aspect, wherein the tubular-topped cap preferably includes a cap body and an inner cap. The cap body constitutes an outer surface, and the inner cap is fit inside the cap body. The first and second resistance portions are formed on an inside of the inner cap.

A third exemplary aspect of the disclosure provides the cosmetic container according to the first or second exemplary aspect, wherein the second resistive portion preferably projects farther inwardly than the first resistive portion so as to have a greater slide resistance than the first resistive portion.

A fourth exemplary aspect of the disclosure provides the cylindrical cosmetic container according to the second or third exemplary aspect, wherein the first and second resistive portions are formed at an inner peripheral surface side of a tubular top portion of the inner cap and slide into contact with an outer peripheral surface of a distal end of the to-be-covered portion of the container body.

A fifth exemplary aspect of the disclosure provides the cosmetic container according to the second, third or fourth exemplary aspect, wherein the inner cap includes cross-sectionally smaller and cross-sectionally larger tubular portions that are respectively located above or below with each other, and the to-be-covered portion includes cross-sectionally smaller and cross-sectionally larger tubular portions that are respectively located above or below each other. The to-be-covered portion can be covered with the inner cap. The cross-sectionally smaller tubular portion of the inner cap is formed with the first resistive portion to be slid into contact with the cross-sectionally smaller tubular portion of the to-be-covered portion. The cross-sectionally larger tubular portion of the inner cap is formed with the second resistive portion to be slid contact with the cross-sectionally larger tubular portion of the to-be-covered portion.

A sixth exemplary aspect of the disclosure provides the cosmetic container according to the second, third or fourth exemplary aspect, wherein the inner cap includes cross-sectionally smaller and cross-sectionally larger tubular portions that are respectively located above or below each other, and the to-be-covered portion includes cross-sectionally smaller and cross-sectionally larger tubular portions that are respectively located above or below each other. The to-be-covered portion can be covered with the inner cap. The cross-sectionally larger tubular portion of the inner cap is formed with the first and second resistive portions to be slid into contact with the cross-sectionally larger tubular portion of the to-be-covered portion.

A seventh exemplary aspect of the disclosure provides the cosmetic container according to the second, third or fourth exemplary aspect, wherein the inner cap includes cross-sectionally smaller and cross-sectionally larger tubular portions that are respectively located above or below each other, and the to-be-covered portion includes cross-sectionally smaller and cross-sectionally larger tubular portions that are respectively located above or below each other. The to-be-covered portion can be covered with the inner cap. The cross-sectionally larger tubular portion of the inner cap is formed with the first resistive portion to be slid into contact with the cross-sectionally larger tubular portion of the to-be-covered portion. The cross-sectionally smaller tubular portion of the inner cap is formed with the second resistive portion to be slid contact with the cross-sectionally smaller tubular portion of the to-be-covered portion.

An eighth exemplary aspect of the disclosure provides the cosmetic container according to the fifth, sixth or seventh exemplary aspect, wherein each of the cross-sectionally smaller and cross-sectionally larger tubular portions of the inner cap and the to-be-covered portion is a circular cylinder.

A ninth exemplary aspect of the disclosure provides the cosmetic container according to the fifth, sixth or seventh exemplary aspect, wherein the cross-sectionally smaller tubular portions of the inner cap and the to-be-covered portion are circular cylinders, and the cross-sectionally larger tubular portions of the inner cap and the to-be-covered portion are non-cylindrical tubes.

A tenth exemplary aspect of the disclosure provides the cosmetic container according to the ninth exemplary aspect, wherein the first resistive portion and/or the second resistive portion are/is formed in a position that is biased to a corner of the non-cylindrical tubes.

An eleventh exemplary aspect of the disclosure provides the cosmetic container according to the tenth exemplary aspect, wherein a pair of the first resistive portions and/or a pair of the second resistive portions are formed at sides of the corner of the non-cylindrical tubes.

A twelfth exemplary aspect of the disclosure provides the cosmetic container according to the tenth or eleventh exemplary aspect, wherein the non-cylindrical tubes are oblong or square tubes, and the corner to which the first resistive portions and/or the second resistive portions are biased is at least a pair of corners that are diagonally located to each other.

A thirteenth exemplary aspect of the disclosure provides the cosmetic container according to the ninth exemplary aspect, wherein the first resistive portion is formed in a position biased to a corner of the non-cylindrical tube and the second resistive portion is formed in a central region positioned between adjacent corners of the non-cylindrical tube.

A fourteenth exemplary aspect of the disclosure provides the cosmetic container according to the thirteenth exemplary aspect, wherein the first resistive portion and the second resistive portion are formed at regions between same adjacent corners, and the first resistive portion is formed between the second resistive portion and one of the corners.

A fifteenth exemplary aspect of the disclosure provides the cosmetic container according to the thirteenth or fourteenth exemplary aspect, wherein the non-cylindrical tubes are oblong or square tubes, and the regions between the adjacent corners on which the first resistive portion and the second resistive portion are formed are positioned at, at least, a pair of opposing surfaces.

A sixteenth exemplary aspect of the disclosure provides the cosmetic container according to one of the second to fifteenth exemplary aspects, wherein a space exists between the cap body and a part on which the first resistive portion and/or the second resistive portion of the inner cap are/is formed. The space defines a deformation margin for allowing the inner cap to deform as the container body presses into sliding contact with the first resistive portion and/or the second resistive portion of the inner cap.

A seventeenth exemplary aspect of the disclosure provides the cosmetic container according to one of the second to sixteenth exemplary aspects, wherein a reinforcement is formed on a part of the inner cap on which at least the second resistive portion is formed. The reinforcement reinforces the second resistive portion.

An eighteenth exemplary aspect of the disclosure provides the cosmetic container according to the seventeenth exemplary aspect, wherein the second resistive portion protrudes from a part of the reinforcement to achieve a deformation margin of at least the second resistive portion.

A nineteenth exemplary aspect of the disclosure provides the cosmetic container according to any one of the first to eighteenth exemplary aspects, wherein the cap includes a third resistive portion formed between the first resistive portion and the second resistive portion, the to-be-covered portion sliding into contact with the third resistive portion in the course of covering the to-be-covered portion.

A twentieth exemplary aspect of the disclosure provides the cosmetic container according to the nineteenth exemplary aspect, wherein a space exists between the cap body and a part on which the third resistive portion of the inner cap is formed, and the space defines a deformation margin for allowing the inner cap to deform as the container body slides into contact with the third resistive portion.

A twenty-first exemplary aspect of the disclosure provides the cosmetic container according to the nineteenth or twentieth exemplary aspect, wherein a reinforcement is formed on a part of the inner cap on which the third resistive portion is formed. The reinforcement reinforces the third resistive portion.

According to the first example aspect, the first slide resistance is smaller than the second slide resistance and occurs while the to-be-covered portion of the container body is covered by cap. The second slide resistance is larger than the first slide resistance and occurs before the to-be-covered portion of the container body is covered fully by the cap. These motion resistances are provided so that the to-be-covered portion of the container body is pressed into sliding contact with the first and second resistive portions that are formed on the inner peripheral surface of the cap. As a result, outer peripheral surfaces of the container body can be simplified into a straight cylindrical shape without a convex rib. Accordingly, there is no structure that will accumulate grime and a superior quality is also achieved.

According to the second exemplary aspect, the tubular-topped cap can be configured easily with the first and/or second resistive portions.

According to the third exemplary aspect, the first and second slide resistances can be provided easily with different levels.

According to the fourth exemplary aspect, the first and second resistive portions can be prevented from being visually recognized from outside because both of the first and second resistive portions are formed on the tubular-topped cap.

According to the fifth exemplary aspect, a slide resistance can be applied at different parts of the inner cap because the first and second resistive portions are formed respectively on the cross-sectionally smaller and cross-sectionally larger tubular portions of the inner cap. A resistance can also be applied stably while the container body is made superior in appearance.

According to the sixth exemplary aspect, even if the distal end of the to-be-covered portion is slanted, the first and second slide resistances can be applied stably to the to-be-covered portion because both of the first and second resistive portions are formed on the cross-sectionally larger tubular portion of the inner cap.

According to the seventh exemplary aspect, a slide resistance can be applied at different parts of the inner cap because the first and second resistive portions are formed respectively on the cross-sectionally larger and cross-sectionally smaller tubular portions of the inner cap. A resistance can also be applied stably while the container body is made superior in appearance.

According to the eighth exemplary aspect, a stable slide resistance can be applied even when the cross-sectionally smaller and cross-sectionally larger tubular portions on the inner cap and the to-be-covered portion are formed to be circular cylindrical shapes.

According to the ninth exemplary aspect, a stable slide resistance can be applied even when the cross-sectionally smaller tubular portions of the inner cap and the to-be-covered portion are formed to be a circular cylindrical shape, and the cross-sectionally larger tubular portions of the inner cap and the to-be-covered portion are formed to be non-cylindrical tubes.

According to the tenth exemplary aspect, the first and/or second resistive portion formed on the cylindrical can be difficult to deform.

According to the eleventh exemplary aspect, the first and/or second resistive portion formed on the non-cylindrical tubes can apply a stable slide resistance with respect to the to-be-covered portion.

According to the twelfth exemplary aspect, the first and/or second resistive portion formed on the non-cylindrical tubes can apply a well-balanced slide resistance with respect to the to-be-covered portion.

According to the thirteenth exemplary aspect, a stable slide resistance can be applied because the first and second resistive portions can be arranged to be well-balanced on the non-cylindrical tube.

According to the fourteenth exemplary aspect, because the first and second resistive portions are positioned in proximity, a smooth sliding shift is carried out between a slide of the first resistive portion and a slide of the second resistive portion while the container body is covered by the cap, with a resultant easy operation. A well-balanced slide resistance also can be achieved because the first and second resistive portions are bilaterally symmetrically positioned between the adjacent corners.

According to the fifteenth exemplary aspect, the slide resistance balance can be improved further.

According to the sixteenth exemplary aspect, the space between the inner cap and the cap body absorbs the expanding deformation that occurs as the container body presses into sliding contact with the first and second resistive portions. Thus, the cap can be covered smoothly onto the container body.

According to the seventeenth exemplary aspect, at least the expanding and deforming second resistive portion can be reinforced at a side of the space. As a result, a case can be avoided where the second resistive portion generating a larger resistance cannot return to its original posture over a repetitive cap covering. A function of the resistive portion also lasts longer.

According to the eighteenth exemplary aspect, the second resistive portion can securely apply the second resistance to the cap and the container body because the reinforcing portion avoids hindering an expanding deformation of the second resistive portion.

According to the nineteenth exemplary aspect, the to-be-covered portion of the container body slides into contact with the third resistive portion on an inner surface of the inner cap after the to-be-covered portion slides into contact with the first resistive portion of the inner cap and before the to-be-covered portion slides into contact with the second resistive portion of the inner cap. Prevented is thus an expansion deformation of a part on which the third resistive portion is formed.

According to the twentieth exemplary aspect, the inner cap can be covered smoothly onto the container body because the space between the inner cap and the cap body absorbs and allows the expanding deformation that occurs when the container body slides into contact with the third resistive portion that applies the third resistance at the time of covering the container body by the cap.

According to the twenty-first exemplary aspect, the potentially expanding and deforming third resistive portion can avoid a case in which the third resistive portion loses its original posture in a state that the third resistive portion remains expanded and deformed due to a repetitive cap covering. A function of the third resistive portion thus lasts longer.

DETAILED DESCRIPTION OF PREFERRED EMBODIMENTS

Figure 1:
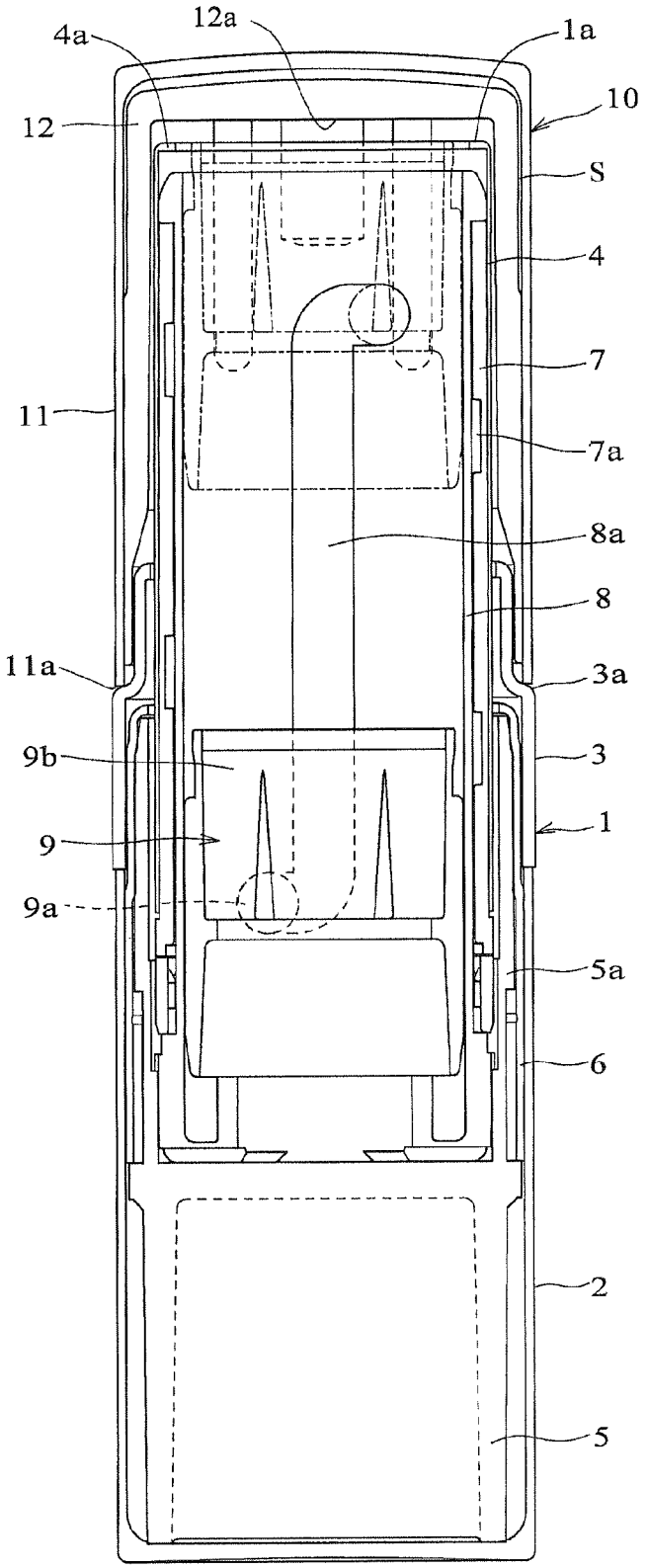
FIG. 1 is a longitudinal sectional view showing a state where a container body is fully covered by a cap.

A cosmetic container in accordance with a first embodiment of the invention includes a container body identified generally by the numeral 1 in FIG. 1. The container body 1 comprises a tubular-bottomed base cylinder 2 and a tubular petticoat cylinder 3 that is positioned above the base cylinder 2 (see FIG. 1). A step 3*a* is provided adjacent the tubular petticoat cylinder 3 and is stepped upwardly and inwardly to a smaller diameter (see FIGS. 1 and 2A-2E). A tubular gripping cylinder 4 is provided at an inner circumferential surface of the tubular petticoat cylinder 3 and is assembled rotatably along the longitudinal axis relative to the base cylinder 2 and the tubular petticoat cylinder 3.

A tubular-bottomed seating portion 5 is fixed inside the base cylinder 2. The seating portion 5 has an upper end 5*a* that extends toward the step 3*a* so as to be held between the tubular petticoat cylinder 3 and the gripping cylinder 4 (see FIG. 1). A fixing cylinder 6 fixes the seating portion 5, the tubular petticoat cylinder 3, and the base cylinder 2.

A spiral cylinder 7 is attached integrally to an inner circumferential surface of the gripping cylinder 4, as shown in FIG. 1. The spiral cylinder 7 has an inner surface that is carved by a spiral groove 7*a*. A middle cylinder 8 is provided at an inner circumferential surface side of the spiral cylinder 7 and is provided with a longitudinally elongated guide hole 8*a*. The middle cylinder 8 is fixed on the seating portion 5 and is configured to rotate integrally with the base cylinder 2.

A vertically movable middle plate body 9 is provided at an inner circumferential surface of the middle cylinder 8 and is provided with a protrusion 9*a* that penetrates through the guide hole 8*a* and engages with the spiral groove 7*a* (see FIG. 1). An accommodating portion 9*b* also is formed on the middle plate body 9 for accommodating a cylindrical cosmetic (not shown). The gripping cylinder 4 can be rotated relative to the base cylinder 2. However, the middle plate body 9 is rotation-controlled along the guide hole 8*a* by the protrusion 9*a*, which is guided slidingly along the spiral groove 7*a*. Thus, the middle plate body 9 can move vertically within the middle cylinder 8 (see FIG. 1).

A cap 10 is fit onto an outside of an upper end of the container body 1 so as to cover the container body 1 (see FIG. 1). The cap 10 comprises a tubular-topped cap body 11; and a tubular-topped inner cap 12 that is attached fixedly to an inside of the cap body 11 (see FIG. 1). A space S is defined between an upper outer circumferential surface of the inner cap 12 and an inner circumferential surface of the cap body 11. The cap 10 thus covers the container body 1, with the gripping cylinder 4 being fit on an inside of the inner cap 12. An opening end 11 a of the cap body 11 abuts against the step 3*a* when the cap 10 is covered fully to form a closed state. In this state, a distal end 4*a* of the gripping cylinder 4 is spaced apart from an innermost end 12*a* of the inner cap 12.

The inner cap 12 has an inner diameter that is slightly larger than an outer diameter of the gripping cylinder 4. Thus, the inner cap 12 allows the gripping cylinder 4 to be fit loosely therein (see FIGS. 2A-2E). First and second protrusions 12*b* and 12*c* are formed on the inner circumferential surface of the inner cap 12 and define first and second resistive portions. The first protrusions 12*b* slide into contact with a distal end 4*a* of the gripping cylinder 4 and with an outer circumferential surface 4*b* adjacent the distal end 4*a* while a covering portion (to-be-covered portion) of the container body 1 is being covered by the cap 10 from a half way position (a halfway covering posture), through an immediately preceding position (an immediately preceding covering posture), and to a fully covered position (a fully covering posture), successively. The second protrusion 12*c* slides in contact with the distal end 4*a* of the gripping cylinder 4 and with the outer circumferential surface 4*b* adjacent the distal end 4*a* while the covering portion (the to-be-covered portion) of the container body 1 is covered by the cap 10 through the immediately preceding covering posture and the fully covering posture, successively. In this embodiment, four first protrusions 12*b* are provided so that two pairs of opposed protrusions are arranged symmetrically, with the first protrusions in each pair being separated by an angle of 180 degrees (FIG. 3B). Two second protrusions 12*c* also are provided between the paired first protrusions 12*b* (see FIG. 3B). Each second protrusion 12*c* protrudes inwardly a greater amount than the first protrusion 12*b* toward the central axis of the cap 10 so as to have a greater motion resistance (slide resistance) against the gripping cylinder 4 toward the first protrusion 12*b*, as compared to the first protrusions 12*b*.

Figure 2A:
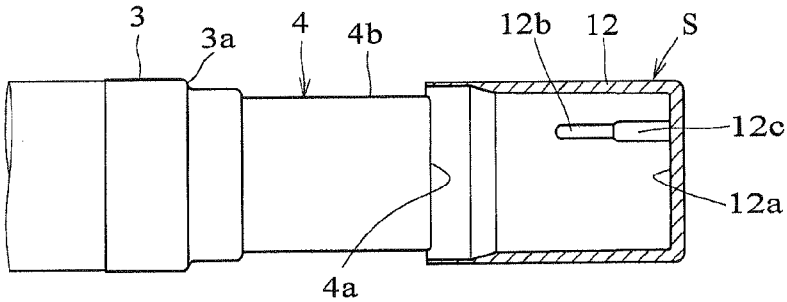
FIGS. 2A to 2E are enlarged longitudinal sectional views of a main part showing a process of covering the cap.
Figure 2B:
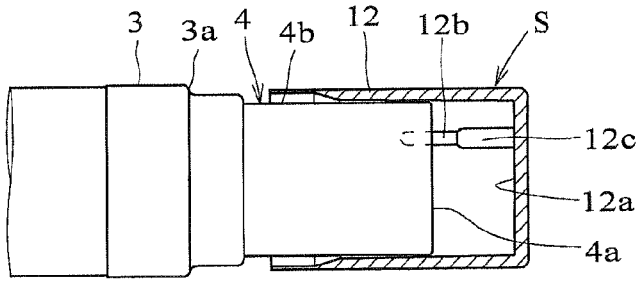
Figure 2C:
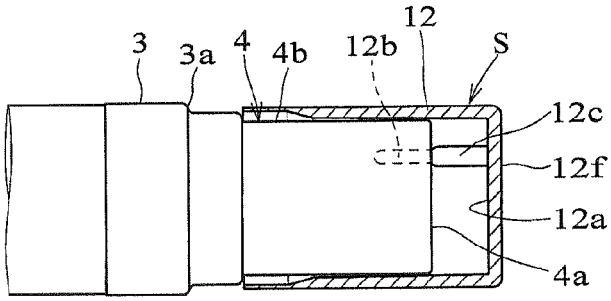
Figure 2D:
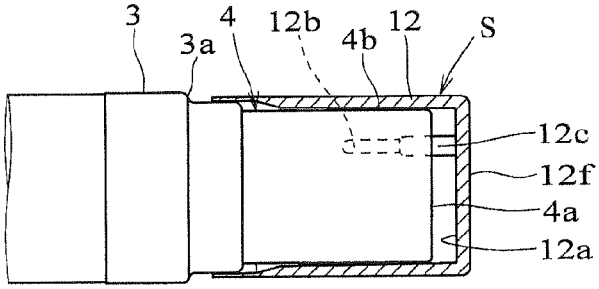
Figure 2E:
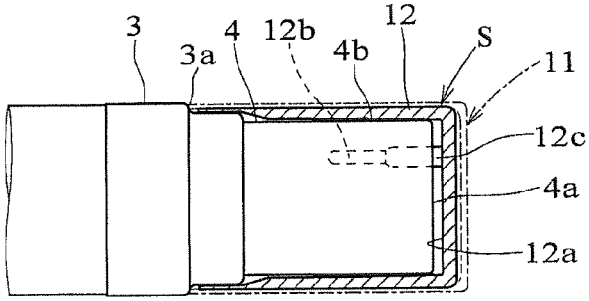
Figure 3B:
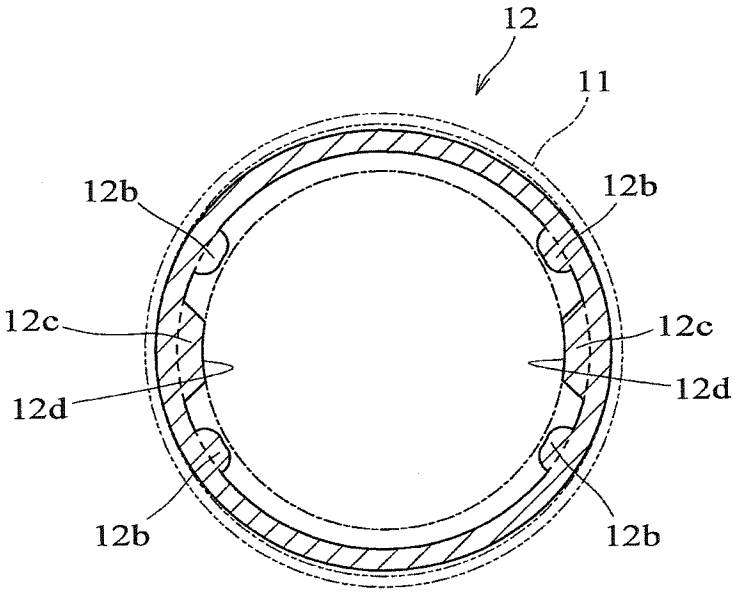
FIG. 3A is a longitudinal sectional view and FIG. 3B is a cross-sectional view of an inner cap.

The distal end 4*a* of the gripping cylinder 4 is fit loosely with the inner cap 12 while the container body 1 initially is being covered by the cap 10 and applies a resistance-free covering before reaching the first protrusion 12*b* (see FIG. 2A). The distal end 4*a* then slides sufficiently to reach the first protrusions 12*b* and thrusts the first protrusion 12*b* in an outer diameter direction so that a first motion resistance is applied (see FIG. 2B). The distal end 4*a* is slid against the first motion resistance of the container body 1 as the container body 1 is covered further by the cap 10 until the distal end 4*a* reaches the second protrusion 12*c* (see FIG. 2C). A projecting distance of the second protrusions 12*c* toward the central axis of the cap 10 exceeds a projecting distance of the first protrusions 12*b* toward the central axis of the cap 10. Hence, sliding contact of the distal end 4*a* against the second protrusions 12*c* thrusts the second protrusions 12*c* in an outer diameter direction and applies a second motion resistance (see FIG. 2D) that is greater than the first motion resistance. A fully covering posture is achieved (see FIG. 2E) when the container body 1 is covered further by the cap 10, with the second motion resistance being applied thereto. A covering force (control force) of an intentional covering is increased because the second motion resistance is applied. The opening end 11*a* of the cap body 11 hits against the step 3*a* at the fully covering posture and produces a snapping or clicking sound. The fully covering posture, in which the container body 1 is fully covered by the cap 10, can thus be confirmed by both a tactile and an auditory sense.

Figure 3A:
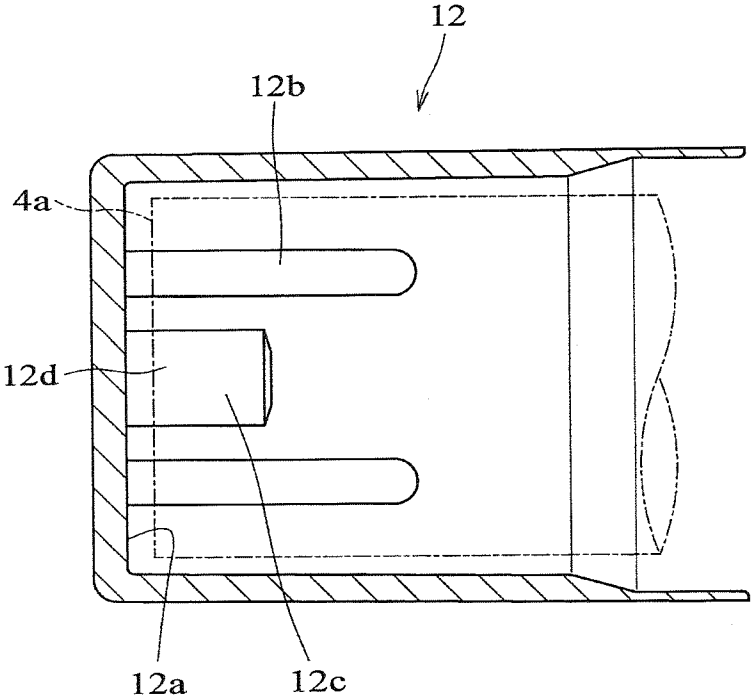

The inner cap 12 is made of a flexible material, such as low-density polyethylene. Thus, the inner cap 12 is deformed into an ellipse shape when the first and the second motion resistances are applied and keeps a thrust state because the first and the second protrusions 12*b* and 12*c* are thrust aside in an outer diameter direction (see FIGS. 3A and 3B). This deformation is absorbed by the space S between the inner cap 12 and the cap body 11. The first and the second protrusions 12*b* and 12*c* each have circular-arc shaped lower ends that abut against the distal end 4*a* of the gripping cylinder 4 when the container body 1 is covered by the cap 10. As a result, the distal end 4*a* of the gripping cylinder 4 is capable of smoothly thrusting and moving over the first and the second protrusions 12*b* and 12*c* while the container body 1 is being covered by the cap 10. A slide contact surface 12*d* is formed on each of the second protrusions 12*c* and defines the part of the respective second protrusion 12*c* that is slid into contact with the distal end 4*a* of the gripping cylinder 4. The slide contact surfaces 12*d* have concave circular arc shapes along an inner circumferential surface and are substantially concentric with the central axis of the inner cap 12.

In the above-described embodiment, a smaller first motion resistance is applied when an upper end 1*a* (the distal end 4*a*) of the container body 1 (the gripping cylinder 4) slides into contact with the first protrusions 12*b* on the inner cap 12 of the cap 10 while the cap 10 is being mounted onto the container body 1. A second larger motion resistance, which is greater than the first motion resistance, subsequently is applied as the upper end 1*a* (the distal end 4*a*) slides into contact with the second protrusions 12*c*. Consequently, the container body 1 is covered fully by the cap 10 with totally well-balanced motion resistances being applied through two phases, namely, a first smaller motion resistance and a second larger motion resistance. The container body thus is covered fully by the cap 10 with stability. The operation of covering the container body 1 with the cap 10 is carried out with a strong covering force at an immediately preceding covering posture prior to a fully covering posture so as to overcome the greater second motion resistance. Thus, a momentum is generated that causes the opening end 11*a* of the cap body 11 to impact against the step 3*a* at the side of the container body 1. As a result, an agreeable hitting snap sound is produced and immediately provides recognition that the container body 1 is covered fully by the cap 10.

As described above, the stable covering of the cap 10 can be achieved by the phased applications of the smaller first motion resistance and the larger second motion resistance in the course of covering with the cap 10. In this embodiment, the first and second protrusions 12*b* and 12*c* are formed in the inner cap 12. The upper end 1*a* of the container body 1 moves into sliding contact and in a thrusting state with the first and second protrusions 12*b* and 12*c* so as to apply the first and the second motion resistances. As a result, the prior art convex rib that easily accumulates grim is unnecessary. As a result, the container can have a straight shape that is easier to form. Additionally, the container has a nice and neat appearance, and creates an impression of an elegant product.

Further, the cap 10 comprises the cap body 11 that is formed with the opening end 11*a*, and the inner cap 12 that is fit into the cap body 11. The first and second protrusions 12*b* and 12*c* are part of the inner cap 12 and can be formed easily. Further, structures for achieving the first and the second slide resistances can be simplified because the projecting amounts of the second protrusions 12*c* exceed the projecting amounts of the first protrusions 12*b*. Accordingly, the structures for achieving the first and the second slide resistances are provided with the different phases.

The invention is not restricted to the foregoing embodiment. A cap of a container may be sufficient if the cap comprises a first resistive portion; and a second resistive portion, wherein the first resistive portion is located at least at a halfway covering posture prior to both an immediately preceding covering posture and a fully covering posture and slides into contact with the upper end 1*a* of the container body 1 while the container body is being covered by the cap so as to apply a first motion resistance. The second resistive portion is located at least at the immediately preceding covering posture prior to the fully covering posture so as to apply a second motion resistance greater than the first motion resistance by being pressed into sliding contact with an upper end of the container body while the container body is being covered by the cap. The cap may also be formed by integrating the cap body and the inner cap. Various inner caps are also possible for resistive portions that apply first and second motion resistances, as shown in FIGS. 4A, 4B, 5A and 5B.

Figure 4B:
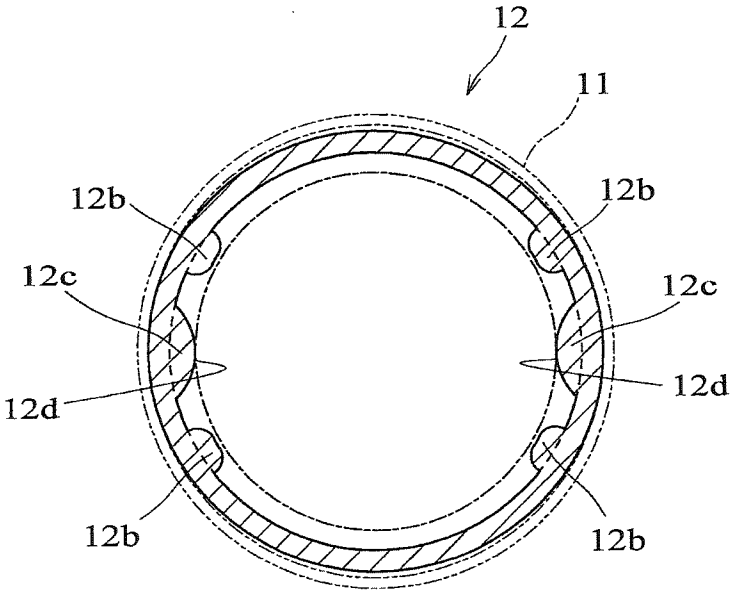
FIG. 4A is a longitudinal sectional view and FIG. 4B is a cross-sectional view of a second embodiment of the inner cap, respectively.
Figure 4A:
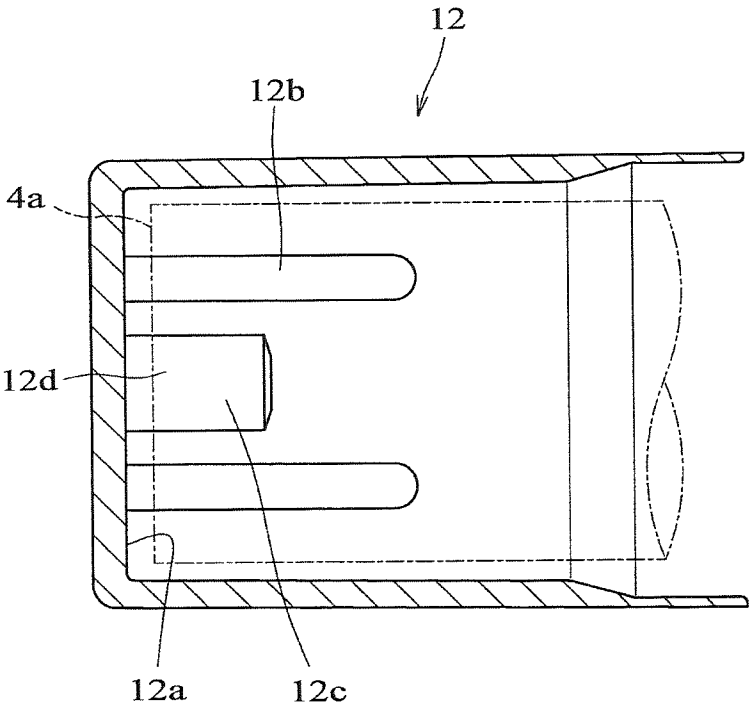
Figure 5B:
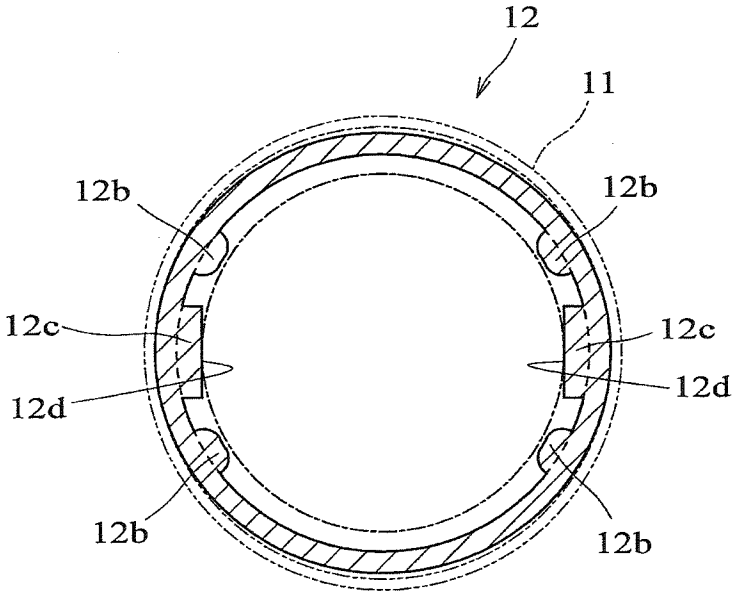
FIG. 5A is a longitudinal sectional view and FIG. 5B is a cross-sectional view of a third embodiment of the inner cap, respectively.
Figure 5A:
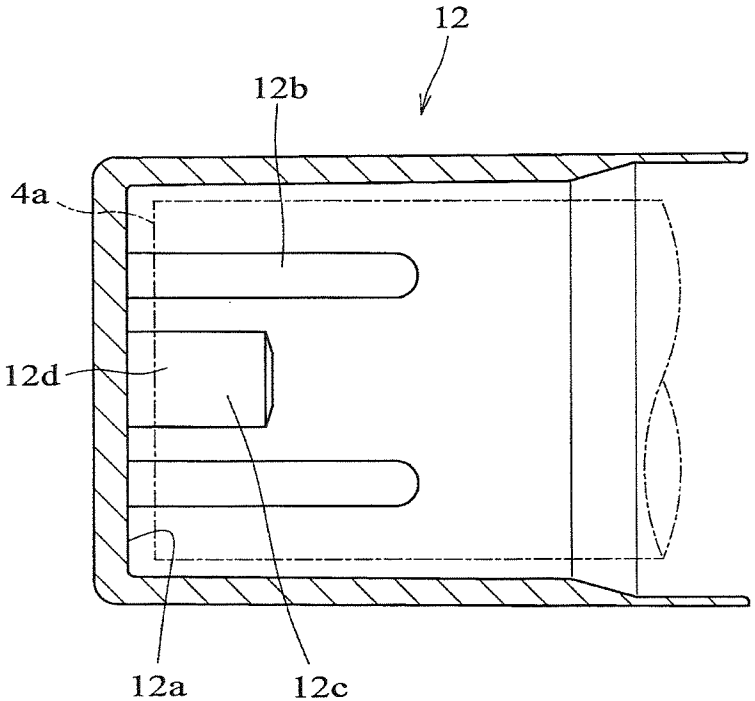

FIGS. 4A and 4B illustrate an inner cap 12 of a second embodiment, and FIGS. 5A and 5B illustrate an inner cap 12 of a third embodiments. In both of the second and third embodiments, the inner cap 12 includes a first protrusion 12*b* and a second protrusion 12*c* provided at the same part as the inner cap 12 of the first embodiments in FIGS. 3A and 3B. While the slide contact surface 12*d* of the second protrusion 12*c* with respect to the container body 1 has a concave shape along the inner circumferential surface of the inner cap 12 of the first embodiment, a second protrusion 12*c* is formed into a circular-arc convex shape (fan shape) so as to protrude in a circumferential direction of the inner cap 12 of the second embodiment illustrated in FIGS. 4A and 4B. A slide contact surface 12*d* of a second protrusion 12*c* is formed into a rectangular shape so as to protrude in a circumferential direction of the inner cap 12 of the third embodiment illustrated in FIGS. 5A and 5B.

Figure 6A:
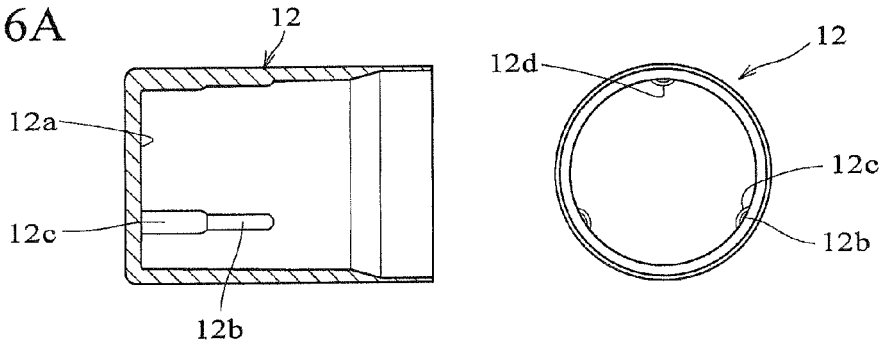
FIGS. 6A to 6D are longitudinal sectional views and bottom views of a fourth to a seventh embodiment of the inner cap, respectively.
Figure 6B:
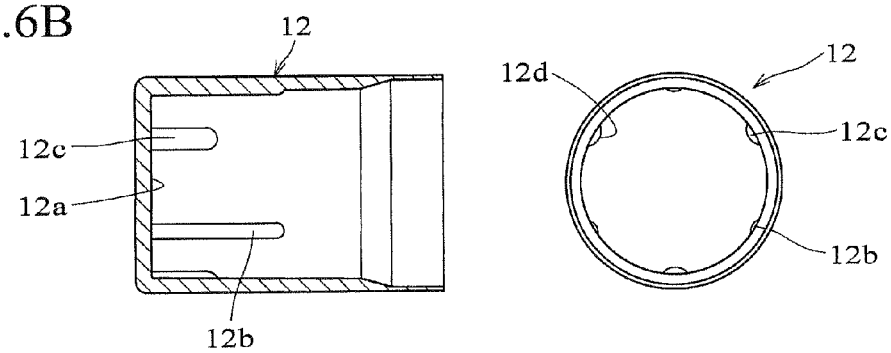
Figure 6C:
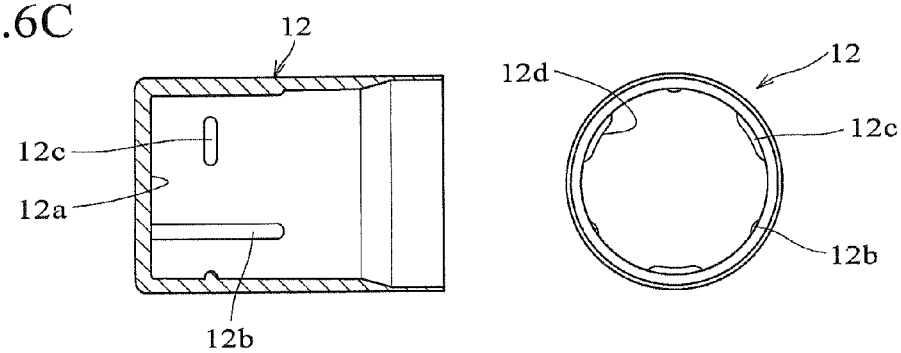
Figure 6D:
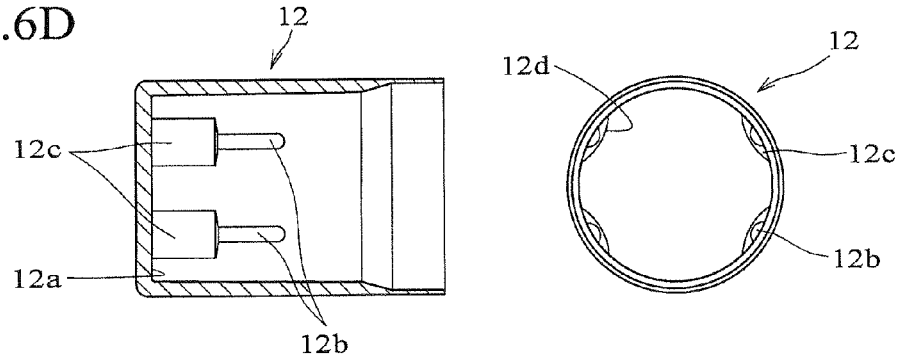

FIG. 6A illustrates an inner cap 12 of a fourth embodiment. This inner cap 12 has an inner circumferential surface provided with a first protrusion 12*b* and a second protrusion 12*c* linearly in an axial direction. FIG. 6B illustrates an inner cap 12 of a fifth embodiment. This inner cap 12 includes a first protrusion 12*b* and a second protrusion 12*c* provided at a regular angle in a circumferential direction. FIG. 6C illustrates an inner cap 12 of a sixth embodiment. This inner cap 12 comprises a first protrusion 12*b* with an axially elongate shape and a second protrusion 12*c* with a circumferentially elongate shape. FIG. 6D illustrates an inner cap 12 of a seventh embodiment. This inner cap 12 includes first and second protrusions 12*b* and 12*c* formed linearly in the axial direction, similar to FIG. 6A. The second protrusion 12*c* of the inner cap 12 of the seventh embodiment, however, has a greater width in a circumferential direction, as compared to the second protrusion 12*c* of the inner cap 12 in FIG. 6A.

Figure 7A:
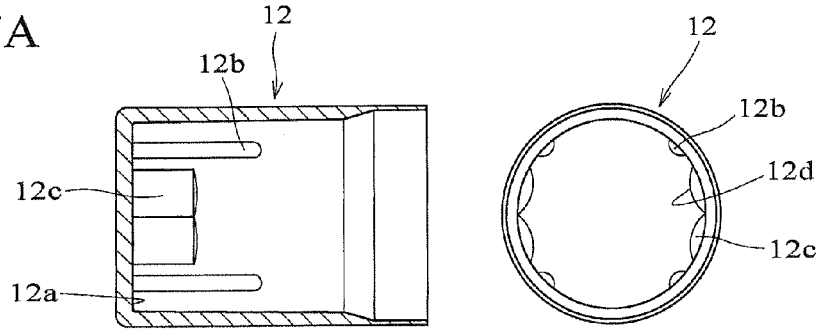
FIGS. 7A to 7C are longitudinal sectional views and bottom views of an eighth to a tenth embodiment of the inner cap, respectively.
Figure 7B:
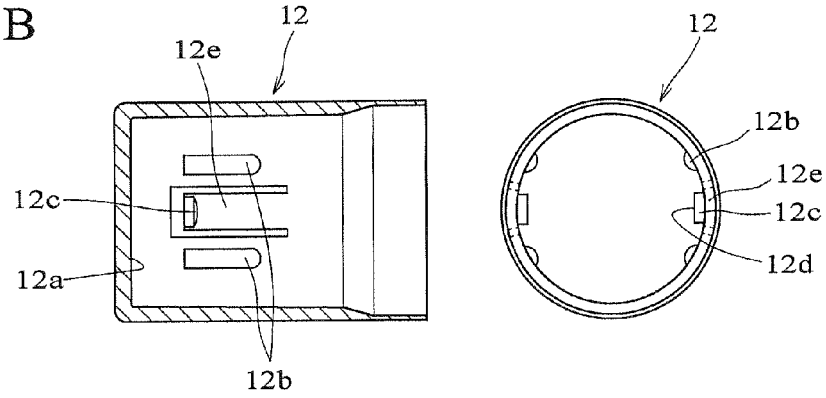
Figure 7C:
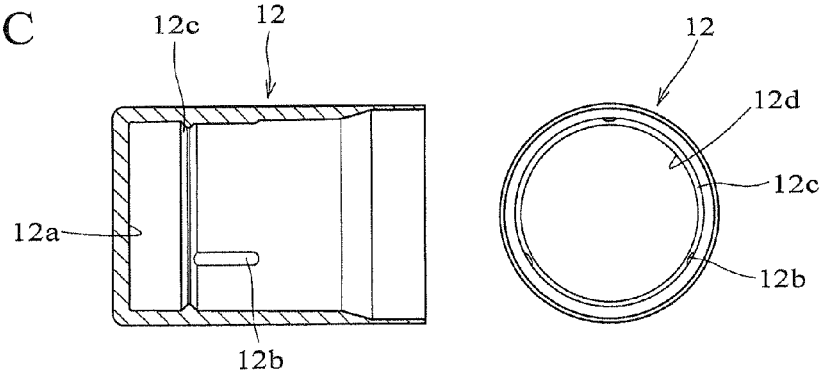

FIG. 7A illustrates an inner cap 12 of an eighth embodiment. This inner cap 12 includes a pair of first protrusions 12*b* and a second protrusion 12*c*. The second protrusion 12*c* is formed to be held between the first protrusions 12*b* and divided circumferentially into two in an angular shape. FIG. 7B illustrates an inner cap 12 of a ninth embodiment. This inner cap 12 includes two first protrusions 12*b*, a second protrusion 12*c* and a tongue 12*e*. The second protrusion 12*c* is formed to be held between the two first protrusions 12*b* and has a periphery that is cut into the tongue 12*e*. An elasticity is applied as a second motion resistance when the second protrusion 12*c* is pressed by an upper end 1*a* of a container body 1 to respond in an outer diameter direction. FIG. 7C illustrates an inner cap 12 of a tenth embodiment. This inner cap 12 includes a first protrusion 12*b* and a second protrusion 12*c*. The first protrusion 12*b* is formed in an axial linear direction and the second protrusion 12*c* is formed into a ring in a circumferential direction.

Figure 8A:
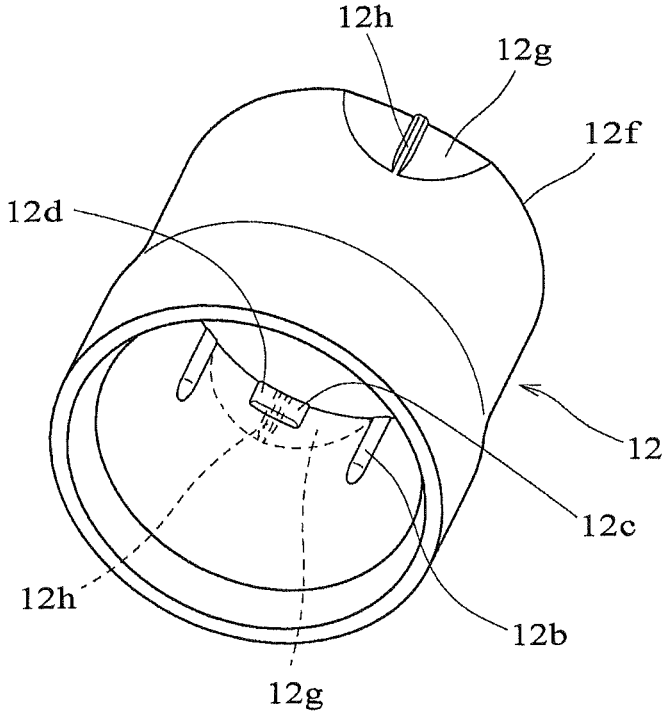
FIG. 8A is a perspective view and FIG. 8B is a longitudinal sectional view of an eleventh embodiment of the inner cap, respectively.
Figure 8B:
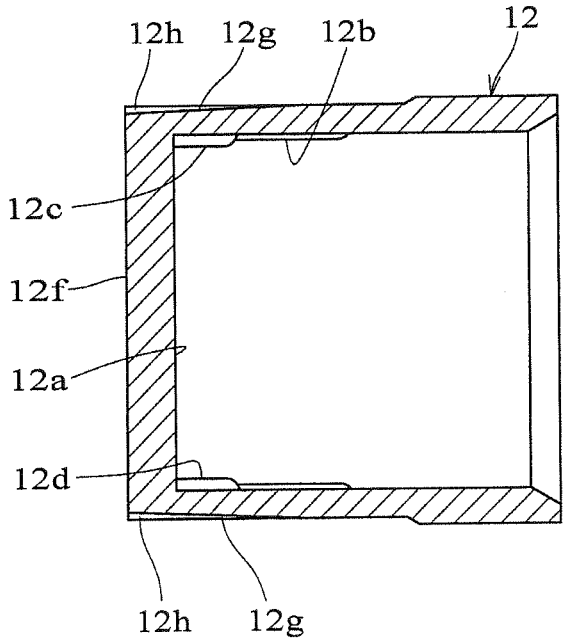
Figure 9:
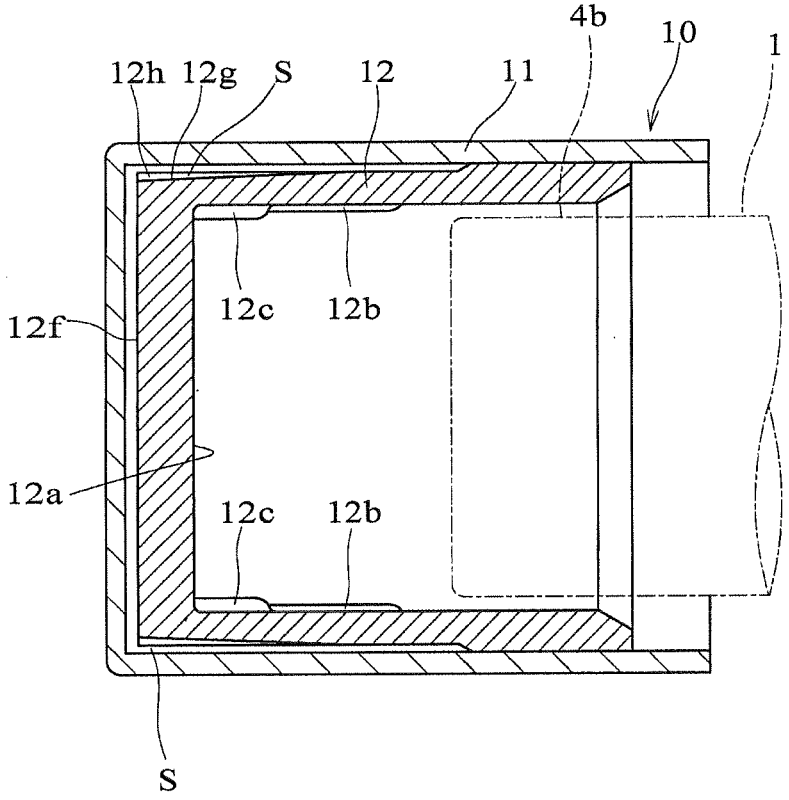
FIG. 9 is a longitudinal sectional view showing the inner cap fitted inside a cap body in the eleventh embodiment.

FIGS. 8A, 8B, and 9 illustrate an inner cap 12 of an eleventh embodiment. This inner cap 12 comprises a first protrusion 12*b*; a second protrusion 12*c*; a ceiling 12*f* defining an outer upper portion of the inner cap 12; and a smaller diameter portion 12*g*. The smaller diameter portion 12*g* is chamfered so as to slant toward the ceiling 12*f* from an outer circumferential surface of a surface portion on which the first and second protrusions 12*b* and 12*c* are formed. As a result, a space S is formed between the inner cap 12 and an inner circumferential surface of the cap body 11 when the inner cap 12 is fit inside the cap body 11, as shown in FIG. 9. In the eleventh embodiment, the first and second protrusions 12*b* and 12*c* are forced to expand from the inner circumferential surface side toward the outer circumferential surface side to be subject to an expanding deformation when an outer circumferential surface 4*b* of the container body 1 presses into sliding contact with the first and second protrusions 12*b* and 12*c*. Nevertheless, the space S defines a deformation margin and absorbs the expanding deformation. As a result, a covering operation of the cap 10 cannot be impaired even if the inner cap 12 is provided with the first and second protrusions 12*b* and 12*c*.

Further, the inner cap 12 of the eleventh embodiment includes a reinforcing rib 12*h* for reinforcing the second protrusion 12*c*. The reinforcing rib 12*h* is formed so as to protrude vertically long on a surface portion on which the smaller diameter portion 12*g* is formed. The reinforcing rib 12*h* can prevent the second protrusion 12*c* from staying in an expanding and deforming state (a permanent deformation state) due to lack of a posture capable of applying a second resistance because of a larger resistance in a frequent cap covering operation or being left with a cap being fully covered under a high temperature atmosphere. As a result, a function of the second protrusion 12*c* lasts longer.

Further in the eleventh embodiment, the reinforcing rib 12*h* is narrower in the circumferential direction than the second protrusion 12*c* such that the second protrusion 12*c* protrudes from the reinforcing rib 12*h*. As a result, a deformation margin of the second protrusion 12*c* can be secured in a portion to which the second protrusion 12*c* protrudes, and the reinforcing rib 12*h* can avoid hindering an expanding deformation of the second protrusion 12*c*. As a result, the second resistance can be applied reliably.

Figure 10A:
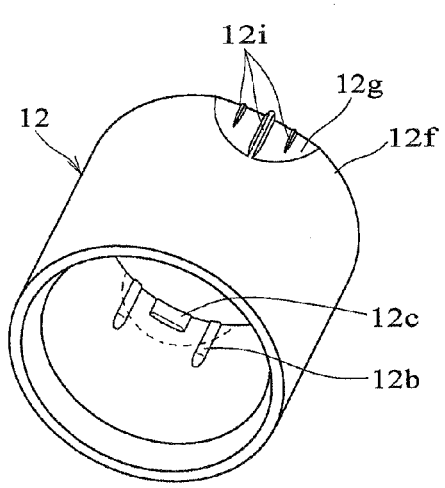
FIGS. 10A to 10D are perspective views of a twelfth to a fifteenth embodiment of the inner cap, respectively.
Figure 10B:
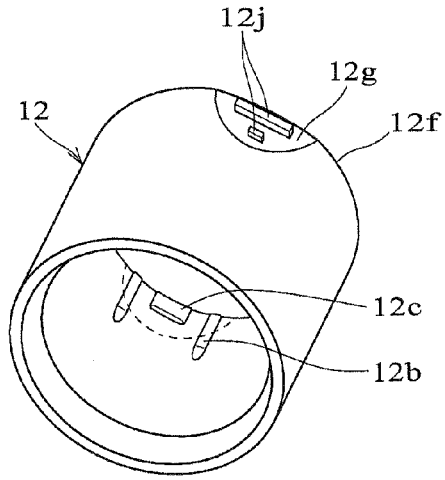
Figure 10C:
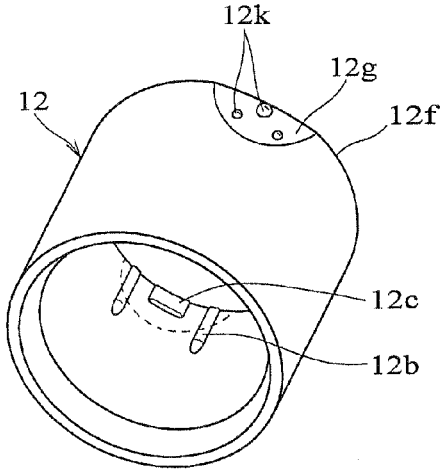
Figure 10D:
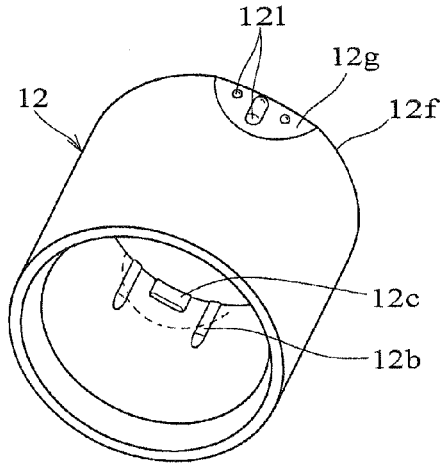

A reinforcing portion is not necessarily limited to such a one piece as the reinforcing rib 12*h*, which formed on the smaller diameter portion 12*g* so as to reinforce only the second protrusion 12*c* as in the above-mentioned embodiment. FIG. 10A illustrates an inner cap 12 of a twelfth embodiment. This inner cap 12 includes a plurality of reinforcing ribs 12*i* formed thereon so as to respectively reinforce first and second protrusions 12*b* and 12*c*. Vertically shorter and narrower reinforcing ribs 12*i* are formed laterally on both sides to reinforce the first protrusion 12*b* while a vertically longer and wider reinforcing rib 12*i* is formed between the shorter and narrower ribs at a central side so as to reinforce the second protrusion 12*c*. FIG. 10B illustrates an inner cap 12 of a thirteenth embodiment. This inner cap 12 includes a plurality of reinforcing ribs 12*j* that are long in a circumferential direction of the inner cap 12. A circumferentially longer reinforcing rib 12*j* is formed closer to a ceiling 12*f* and reinforces both first and second protrusions 12*b* and 12*c*, whereas a shorter rib is farther from the ceiling 12*f* and reinforces only the second protrusion 12*b*. FIG. 10C illustrates an inner cap 12 of a fourteenth embodiment. This inner cap 12 includes reinforcing dotted protrusions 12*k* that correspond to first and second protrusions 12*b* and 12*c*. Smaller reinforcing protrusions 12*k* reinforce the first protrusion 12*b* while a larger reinforcing protrusion 12*k* reinforces the second protrusion 12*c*. FIG. 10D illustrates an inner cap 12 of a fifteenth embodiment. This inner cap 12 includes reinforcing protrusions 12*l* provided in a reversed arrangement to those reinforcing protrusions shown in FIG. 10C. An oval reinforcing protrusion 12*l* is longer in an axis direction of the inner cap 12 and reinforces a second protrusion 12*c*.

A reinforcing portion is formed to reinforce at least a second resistive portion having a larger resistance. Optionally, the reinforcing portion can also be set to reinforce a first resistive portion as well as the second resistive portion. A specific shape, number, and arrangement of the reinforcing portions also can be set optionally. Preferably, a deformation margin of the resistive portion should be secured by configuring such that a part of the resistive portion has a portion protruding from the reinforcing portion so that the reinforcing portion avoids hindering an expanding deformation of the resistive portion reinforced by the reinforcing portion.

FIGS. 11A, 11B, 12A, and 12B illustrate an inner cap 12 of a sixteenth embodiment. This inner cap 12 includes a smaller inner diameter portion 12*m* closer to an innermost end 12*a* at an upper side, the smaller inner diameter portion 12*m* being an example of a cross-sectionally smaller tubular portion of the inner cap 12 of the present disclosure; an opening end 12*n* at a lower end; and a larger inner diameter portion 12*p* closer to the opening end 12*n*, the larger inner diameter portion 12*p* being an example of a cross-sectionally larger tubular portion of the inner cap 12 of the present disclosure. The container body 1 has a to-be-covered portion 13 to be covered by the inner cap 12. An upper end of the to-be-covered portion 13 has a gripping cylinder 4 that defines a smaller diameter portion 13*a*. The smaller diameter portion 13*a* is an example of a cross-sectionally smaller tubular portion of the to-be-covered portion 13 of the present disclosure. The container body 1 also has a tubular petticoat cylinder 3 at a lower position on the to-be-covered portion 13. The tubular petticoat cylinder 3 defines a larger diameter portion 13*b* that is an example of a cross-sectionally larger tubular portion of the to-be-covered portion 13 of the present disclosure. A first resistive portion is formed at an inner surface side of the smaller diameter portion 12*m*, and a second resistive portion is formed on the larger inner diameter portion 12*p*.

First protrusions 12*q* (three in this embodiment) are formed on the inner circumferential surface of the smaller diameter portion 12*m* of the inner cap 12 adjacent the innermost end 12*a* to define first resistive portions. The first protrusions 12*q* are long in an axial direction and at proper angles in the circumferential direction. Hemispherical second protrusions 12*r* (three in this embodiment) are formed on the inner circumferential surface of the larger inner diameter portion 12*p* of the inner cap 12 to define second resistive portions at proper angles in the circumferential direction. The second protrusions 12*r* are dimensioned and configured to have a larger slide resistance than a slide resistance of the first protrusions 12*q* with respect to the container body 1 (see FIG. 12A).

In the above-described embodiment, the first and second protrusions 12*q* and 12*r* are arranged so as not to be axially aligned with each other. Nevertheless, an arrangement of the first and second protrusions 12*q* and 12*r* are not limited to the above-specified arrangement, and shapes of the first and second protrusions 12*q* and 12*r* can be modified.

Figure 12B:
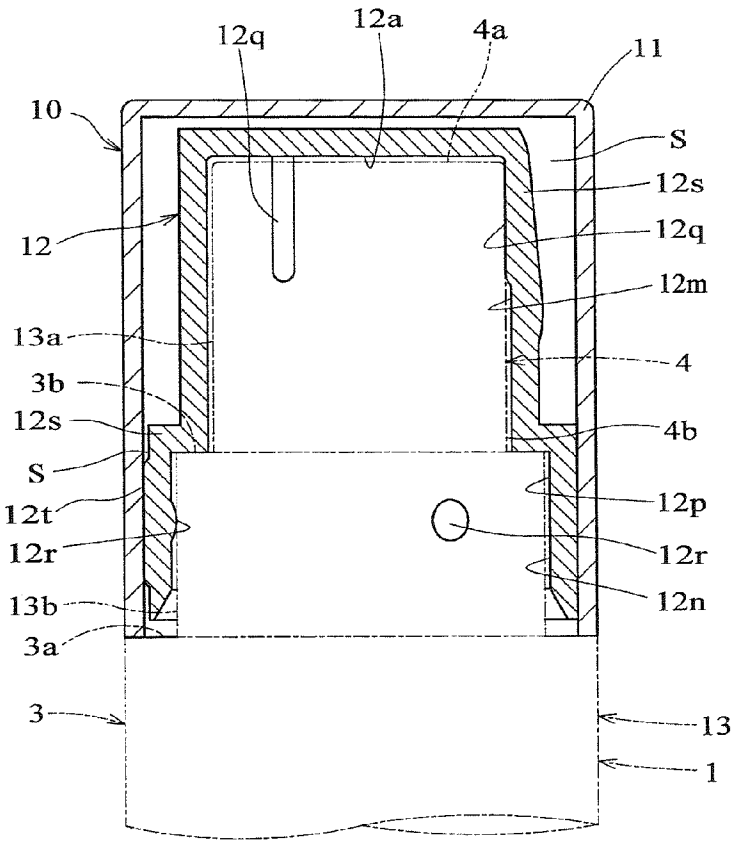
FIGS. 12A and 12B are enlarged longitudinal sectional views of a main part showing a process of covering the cap in the sixteenth embodiment.
Figure 12A:
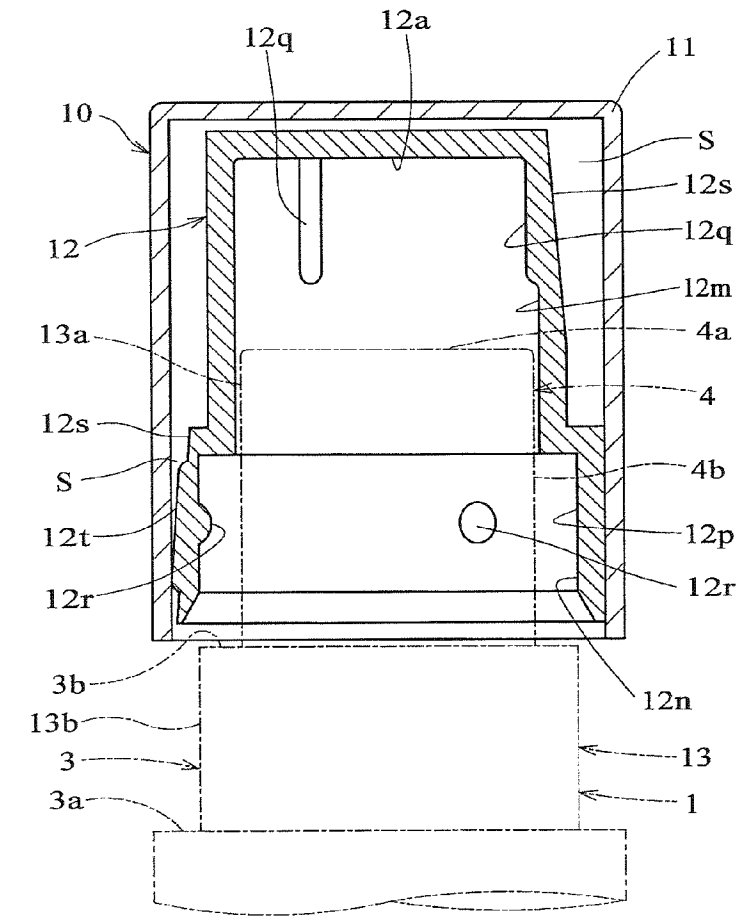

A space S is formed between the cap body 11 and an outer circumferential surface side of both of the first and second protrusions 12*q* and 12*r* (see FIGS. 12A and 12B). The space S defines a deformation margin to accept an expanding deformation when the container body 1 presses into sliding contact with the first and second protrusions 12*q* and 12*r*. Thus, the function of the space S is the same as in the first embodiment.

A distal end 4*a* and an outer circumferential surface 4*b* of the gripping cylinder 4, which is the smaller diameter portion 13*a* of the to-be-covered portion 13, presses into sliding contact with the first protrusion 12*q* formed on the smaller inner diameter portion 12*m* of the inner cap 12, while the container body 1 is being covered by the cap 10 and while the inner cap 12 is fit inside the cap 10. When the container body 1 is covered further by the cap 10, an upper end 3*b* of the tubular petticoat cylinder 3, which is the larger diameter portion 13*b* of the to-be-covered portion 13, presses into sliding contact with the second protrusions 12*r* formed on the larger inner diameter portion 12*p*. The container body 1 is covered fully by the cap 10 (see FIG. 12B), as the upper end 3*b* moves over the second protrusions 12*r*. A covering force that is generated when the upper end 3*b* moves over the second protrusion 12*r* is greater than a covering force that is generated when the first protrusion 12*q* is slid into contacting with the distal end 4*a* of the gripping cylinder 4 because the second protrusions 12*r* generates a larger resistance than the first protrusion 12*q*. As a result, a snapping or clicking sound is produced as a lower end of the cap 10 impacts and abuts against a step 3*a* formed on the tubular petticoat cylinder 3.

By the above-mentioned construction, the first and second resistive portions are formed respectively at upper and lower ends of the inner cap 12 defining the first and second protrusions 12*q* and 12*r*. As a result, well-balanced resistances can be applied while the container body 1 acquires a superior appearance.

Figure 11A:
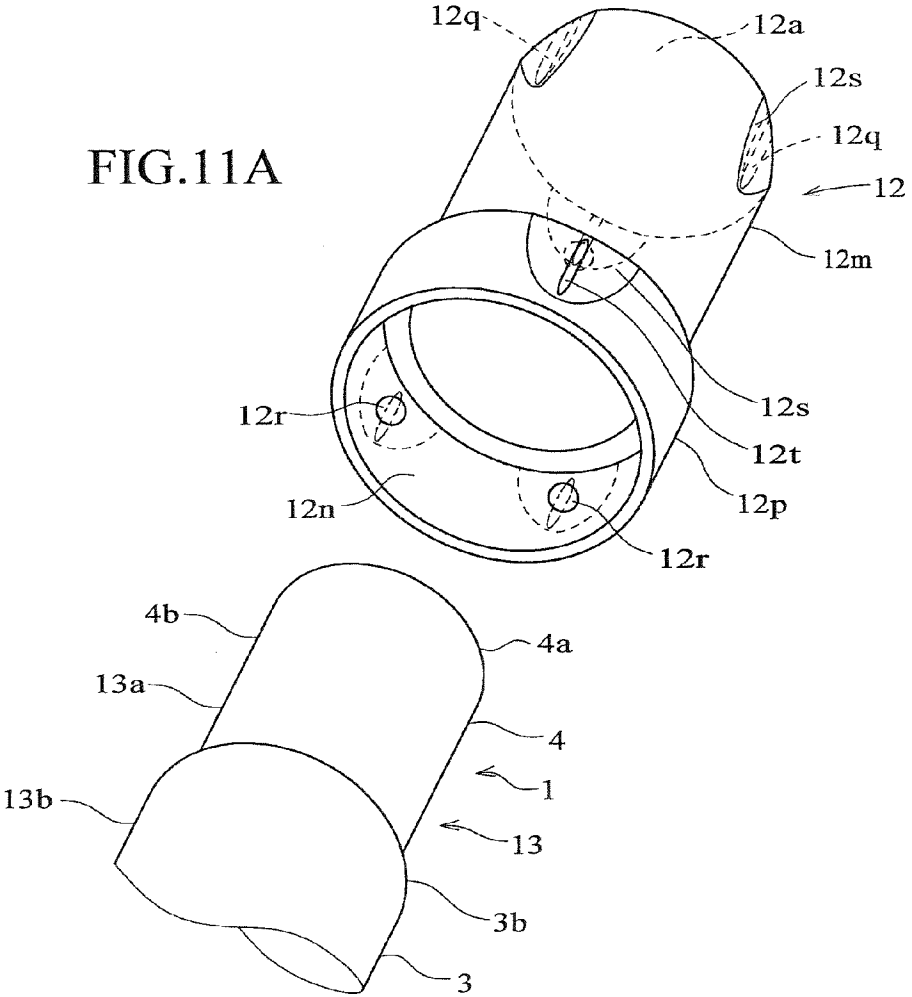
FIG. 11A is a perspective view and FIG. 11B is a bottom view of a sixteenth embodiment of the inner cap, respectively.
Figure 11B:
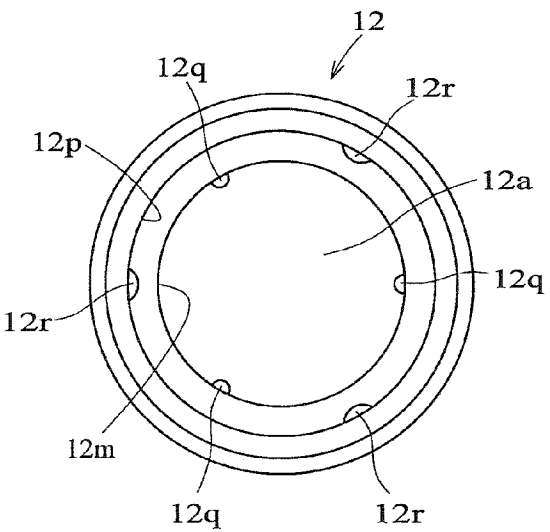

Further, smaller diameter portions 12*s*, as in the inner cap 12 of the eleventh embodiment, are chamfered and slant toward an upper end at an outer circumferential surface of the part on which the first and second protrusions 12*q* and 12*r* are formed (see FIGS. 11A, 12A, and 12B). A reinforcing rib 12*t* protrudes from an outer circumferential surface of the smaller diameter portion 12*s* at a position opposite the second protrusion 12*r* for reinforcing the second protrusion 12*r*. This configuration prevents a permanent deformation state despite frequent use or use under a higher temperature atmosphere.

Figure 13:
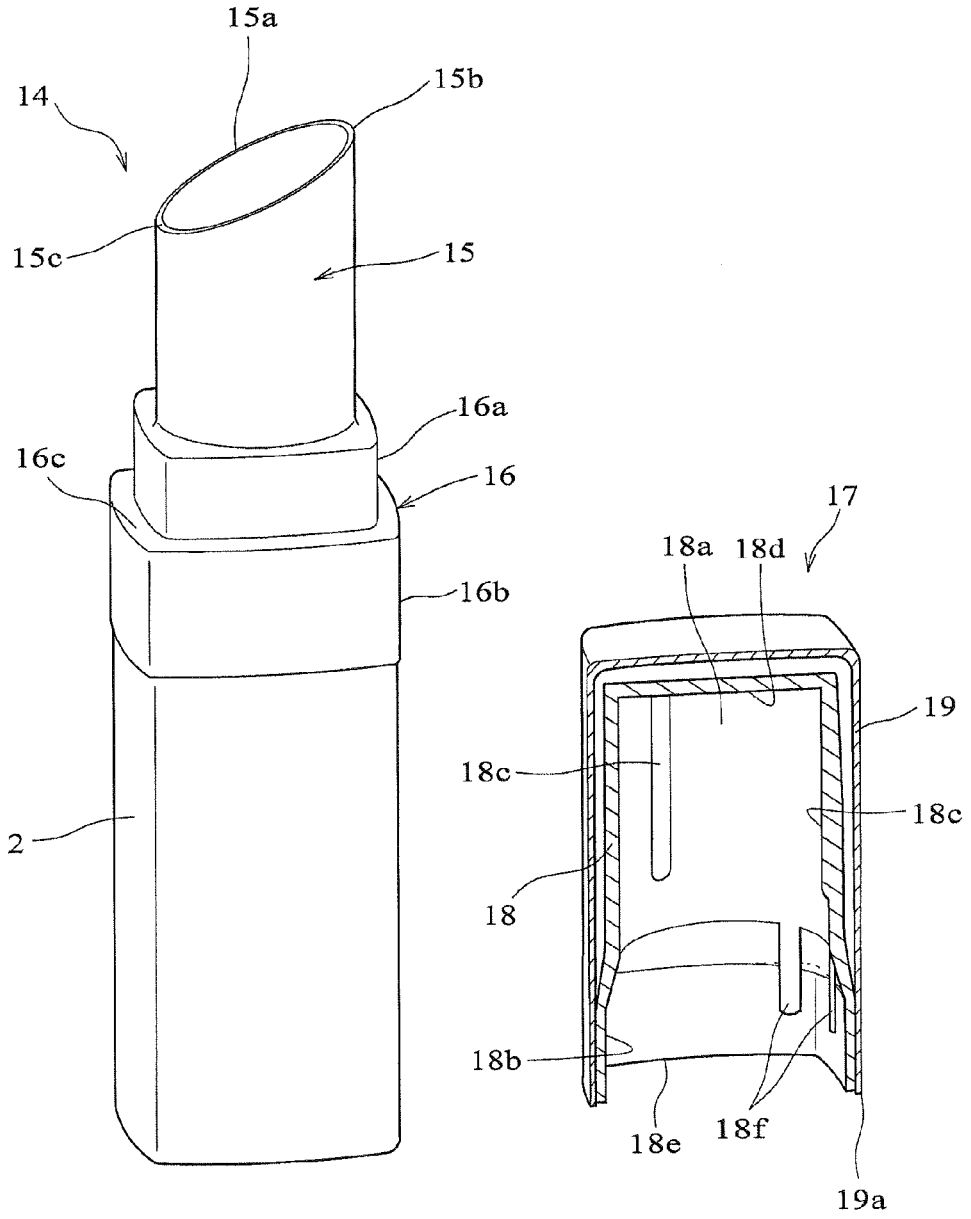
FIG. 13 is perspective view of a container body and a sectional view of a cap in a seventeenth embodiment.
Figure 14A:
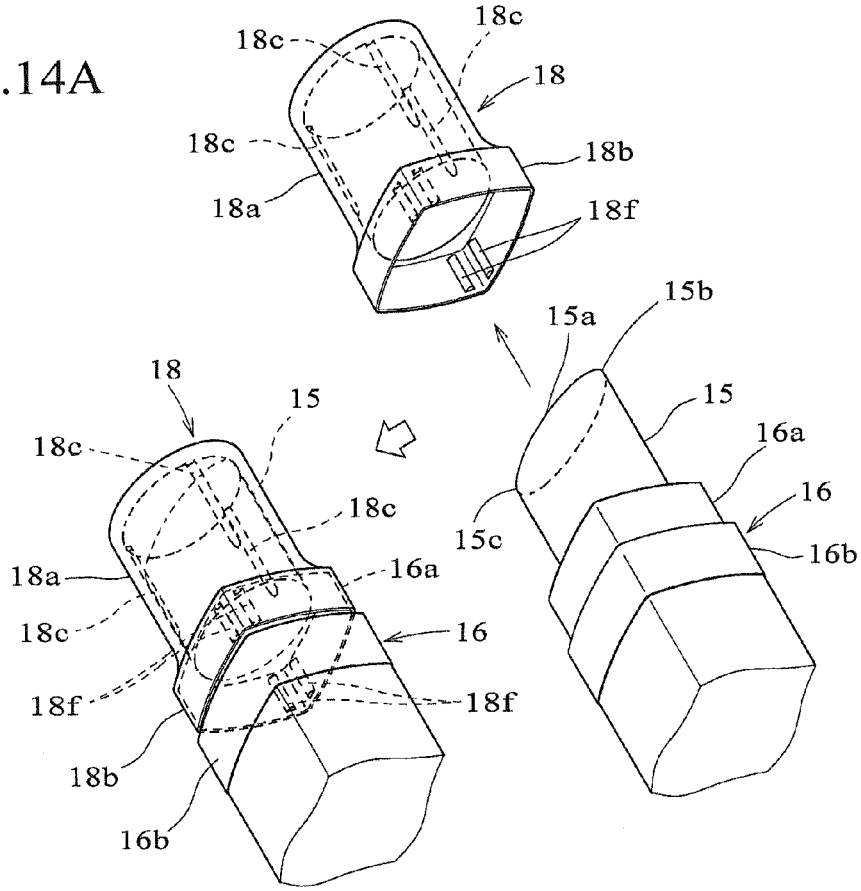
FIG. 14A is a perspective view of a pre-covering and a post-covering and FIG. 14B is a longitudinal sectional view of a covered state of an upper portion of the container body and an inner cap in the seventeenth embodiment.
Figure 14B:
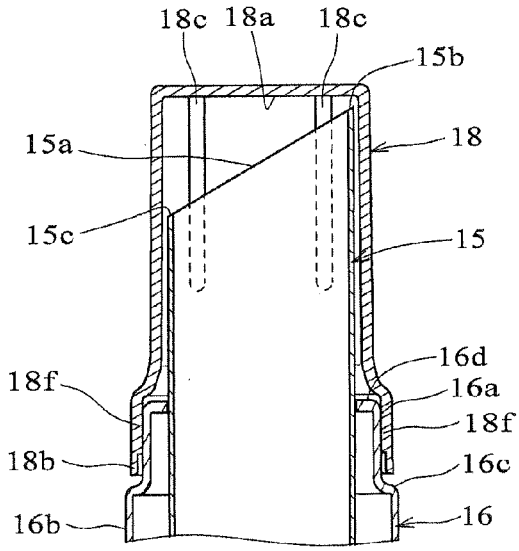

FIGS. 13, 14A and 14B illustrates a cosmetic container of a seventeenth embodiment. A distal end 15*a* of a gripping cylinder 15 is slanted in side view. A petticoat tube 16 is at a lower side of the gripping cylinder 15. The petticoat tube 16 includes a thinner or cross-sectionally smaller generally rectangular or oblong tube 16*a* with alternating long and short sides adjacent the gripping cylinder 15. The petticoat tube 16 also includes a thicker or cross-sectionally larger generally rectangular or oblong tube 16*b* with alternating long and short sides below the cross-sectionally smaller tube 16*a*. The term "generally" reflects the fact that at least the two shorter sides are not perfectly planar, but rather are slightly arcuate, as shown in FIG. 13. A step 16*c* is defined between the tubes 16*a* and 16*b*. A cap 17 can be telescoped over the gripping cylinder 15 and the cross-sectionally smaller tube 16*a* so that an opening end 19*a* of the cap 17 abuts against the step 16*c* when the cap 17 is in a full covering position. The cap 17 includes an inner cap 18 with a cylindrical top tube 18*a* at an upper side; and a generally rectangular or oblong tube 18*b* at a lower side. While the container body 14 is covered with the cap 17, the cylindrical top tube 18*a* of the inner cap 18 fits outside the gripping cylinder 15 and the generally oblong tube 18*b* fits outside the cross-sectionally smaller tube 16*a* of the petticoat tube 16.

Figure 15B:
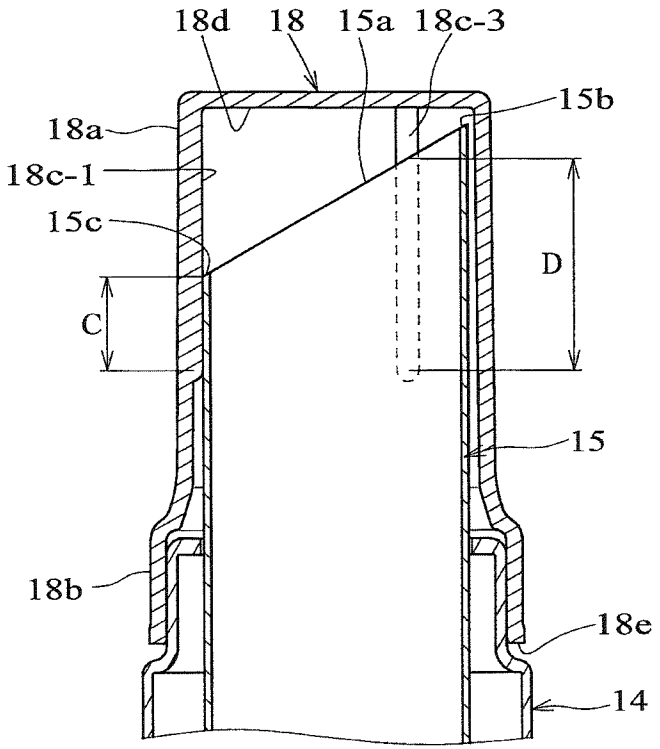
FIGS. 15A and 15B are longitudinal sectional views showing a relationship between a gripping portion and first protrusions in the seventeenth embodiment.
Figure 15A:
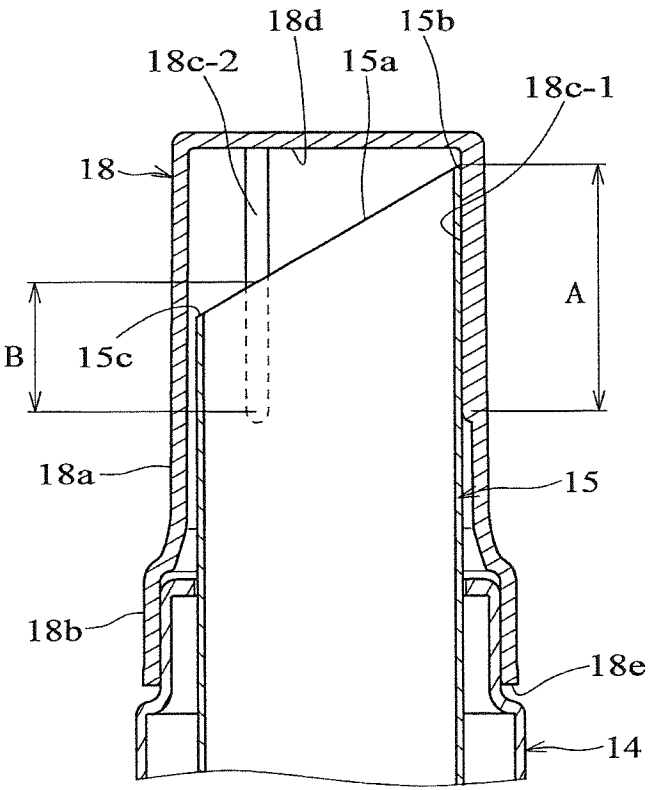

Three first protrusions 18*c* are formed inside the cylindrical top tube 18*a* of the inner cap 18 to extend across a part of the container body 14 where the distal end 15*a* of the gripping cylinder 15 is slanted. The first protrusions 18*c* are spaced at an angle of 120 degrees from one another in the circumferential direction and extend longitudinally from an innermost end 18*d* toward an opening end 18*e*. An abutting length between the first protrusions 18*c* and an outer circumferential surface of the gripping cylinder 15 is different at the time of covering the gripping cylinder 15 with the inner cap 18 between a case in which a first protrusion 18*c*-1 slides in to contact with a top region 15*b* that is a highest in the distal end 15*a* of the gripping cylinder 15 (see FIG. 15A) and a case in which the first protrusion 18*c*-1 slides into contact with a bottom region 15*c* that is a lowest in the distal end 15*a* of the gripping cylinder 15 (see FIG. 15B). More specifically, when the first protrusion 18*c*-1 slides into contact at the top region 15*b* of the gripping cylinder 15, a slide-contact length of the first protrusion 18*c*-1 with respect to an outer circumferential surface of the gripping cylinder 15 is set to be A, whereas each slide-contact length of a first protrusion 18*c*-2 and first protrusion 18*c*-3 is set to be B (see FIG. 15A). In contrast, when the first protrusion 18*c*-1 slides into contact at the bottom region 15*c* of the gripping cylinder 15, a slide-contact length of the first protrusion 18*c*-1 with respect to an outer circumferential surface of the gripping cylinder 15 is set to be C, whereas each slide-contact length of the first protrusion 18*c*-2 and first protrusion 18*c*-3 is set to be D (see FIG. 15B). Slide resistances in the circumferential direction and axial direction of the gripping cylinder 15 are different when covering the inner cap 18 on the gripping cylinder 15 because a circumferential positional relationship is different in a slant direction of the distal end 15*a* of the gripping cylinder 15 and the first protrusions 18*c*. Accordingly, the cap 17 is covered in a biased state if the container body 14 is subject only to a slide resistance of the first protrusions 18*c* of the inner cap 18 so as to be covered.

Figure 16A:
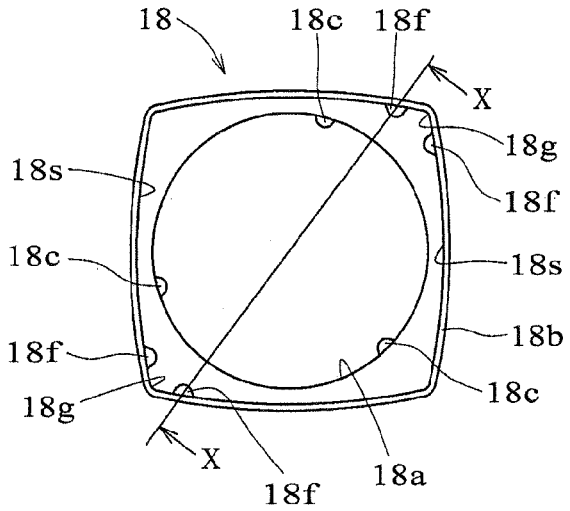
FIG. 16A is a bottom view of the inner cap in the seventeenth embodiment.
Figure 16B:
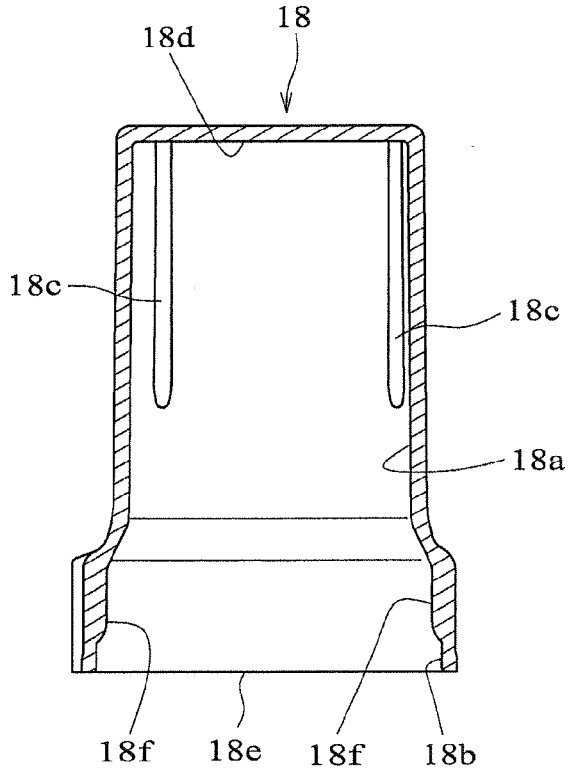
FIG. 16B is a sectional view taken along line X-X in FIG. 16A.

A covering of the first protrusions 18*c* with respect to the gripping cylinder 15 is unsteady in the container body 14 where the distal end 15*a* of the gripping cylinder 15 is slanted. Such an unsteady covering can be corrected using a slide movement of second protrusions 18*f* with respect to the petticoat tube 16. Accordingly, the second protrusions 18*f* are formed at the generally oblong tube 18*b* that defines the opening end 18*e* of the inner cap 18 (see FIGS. 16A and 16B). More specifically, a corner 18*g* is formed at four corners on an inner surface of the oblong tube 18*b*. The second protrusion 18*f* is formed to protrude at each side of opposing two corners 18*g*, each of the second protrusions 18*f* being positioned to be biased toward the corners 18*g* (See FIG. 16A). Thus, the second protrusions 18*f* apply a slide resistance to the to-be-covered portion that is greater than the slide resistance of the first protrusions 18*c*.

An unstable covering is corrected by the second protrusions 18*f* at the oblong tube 18*b* of the inner cap 18 based on the above-described configuration even if the first protrusions 18*c* cause an off-balance slide resistance in the container body 14 where the distal end 15*a* of the gripping cylinder 15 is slanted. That is, an overall well-balanced slide resistance can be achieved.

Further, the corners 18*g* of the oblong tube 18*b*, which have the second protrusions 18*f*, are stronger than a flat surface portion 18*s*. Accordingly, as with other embodiments of the present disclosure, the second protrusions 18*f* yields a slide resistance larger than that of the first protrusions 18*c*, and a clicking sound is produced at the time of a fully covering posture.

The distal end 15*a* of the gripping cylinder 15 is not limited to a slanted shape in the seventeenth embodiment. This embodiment also can be carried out using a distal end 15*a* that is horizontal and normal to the axis of the gripping cylinder 15. In this case, the second protrusions 18*f* are given no function to correct an off-balance slide resistance, because the first protrusions 18*c* do not cause off-balance slide resistances. The first and second protrusions 18*c* and 18*f* are formed respectively on the circular cylindrical top tube 18*a* and the oblong tube 18*b*, the former of which is the upper side of the inner cap 18, and the latter is the lower side of the inner cap 18. As a result, the first and second resistive portions are formed spaced from each other. Thus, a covering of the cap 17 is stable with respect to the container body 14.

Further, the petticoat tube 16 can be applied to various shaped container bodies even if the petticoat 16 is formed to have a circular tubular shape, though the inner cap 18 applies a slide resistance to the petticoat tube 16 formed to be a generally rectangular or oblong tube in this embodiment.

Figure 17A:
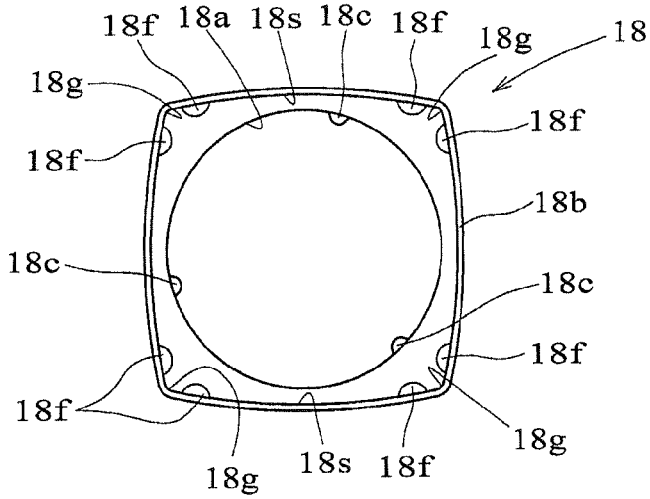
FIGS. 17A, 17B and 17C are bottom views of an inner cap showing eighteenth, nineteenth and twentieth embodiments, respectively.
Figure 17B:
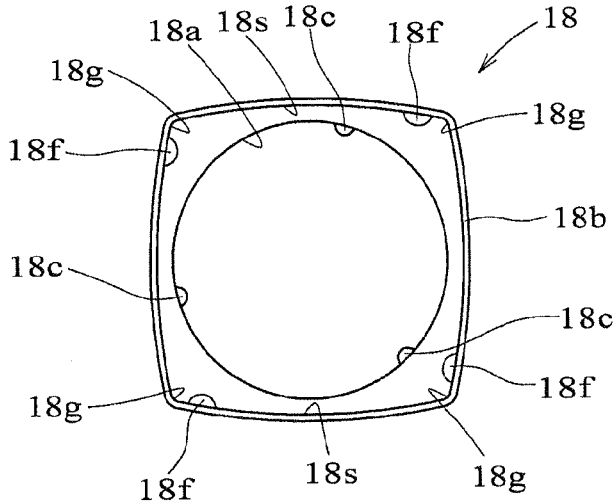
Figure 17C:
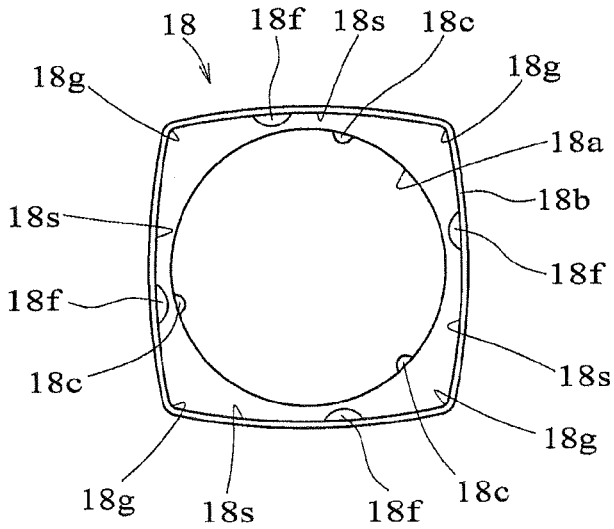

The regions at which the second protrusions 18*f* are formed are not limited to two corners 18*g* that are opposed to each other. The second protrusion 18*f* may be formed around all of the corners 18*g*, as an eighteenth embodiment (see FIG. 17A). The second protrusion 18*f* may be formed at only one side end of every corner 18*g* (a right hand side relative to a corner when viewed from outside), as a nineteenth embodiment (see FIG. 17B). The second protrusion 18*f* may be formed on a flat surface portion 18*s* of an generally oblong tube 18*b*, the second protrusions 18*f* being positioned to be slightly biased toward the generally oblong tube 18*b*, as a twentieth embodiment (see FIG. 17C). A clicking sound is produced when a fully covering posture is achieved in accordance with these various embodiments as well as other embodiments of the present disclosure.

Figure 18A:
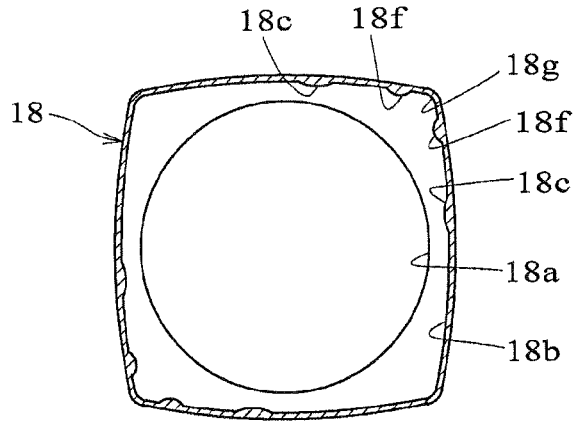
FIGS. 18A and 18B are a bottom sectional view of an inner cap and a bottom sectional view showing a state where the inner cap covers a container body in a twenty-first embodiment.
Figure 18B:
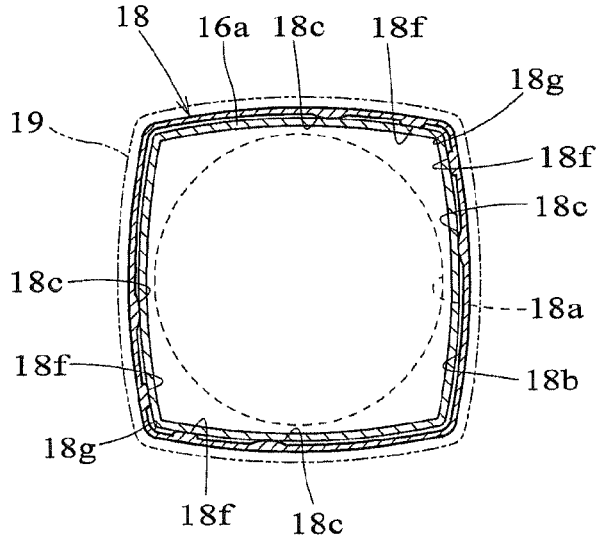
Figure 18C:
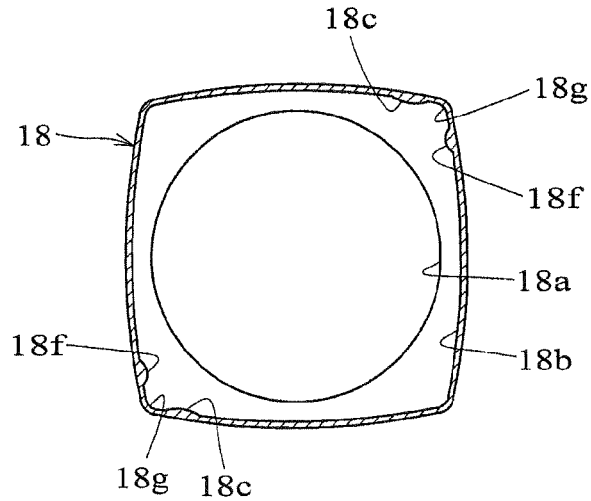
FIG. 18C is a bottom sectional view of an inner cap showing a variation of the twenty-first embodiment.

First and second protrusions 18*c* and 18*f* may be formed with a generally square tube 18*b*, as a twenty-first embodiment (see FIGS. 18A and 18B). An inner cap 18 includes cross-sectionally smaller and cross-sectionally larger tubular portions, and the generally square tube 18*b* is the cross-sectionally larger tubular portion. In this embodiment, the first protrusions 18*c* protrude toward an inner side of the generally square tube 18*b* at a pair of corners 18*g* of the generally square tube 18*b* that are diagonal to each other. That is, the first protrusion 18*c* is positioned at each side of the pair of corners 18*g* and biased toward the corners 18*g*. The second protrusion 18*f* is formed between the corners 18 and the first protrusions 18*c* so as to protrude toward the inner side of the generally square tube 18*b*. A projection amount of the second protrusion 18*f* is larger than that of the first protrusions 18*c*. Accordingly, four pieces of the first and second protrusions 18C and 18*f* are formed to protrude, face each other and center around the pair of corners 18*g*. Further, the first and second protrusions 18*c* and 18*f* may be formed on the generally square tube 18*b* so as to be paired across respective corners 18*g* in a diagonal position, as a variation of the twenty-first embodiment (see FIG. 18C).

Figure 19A:
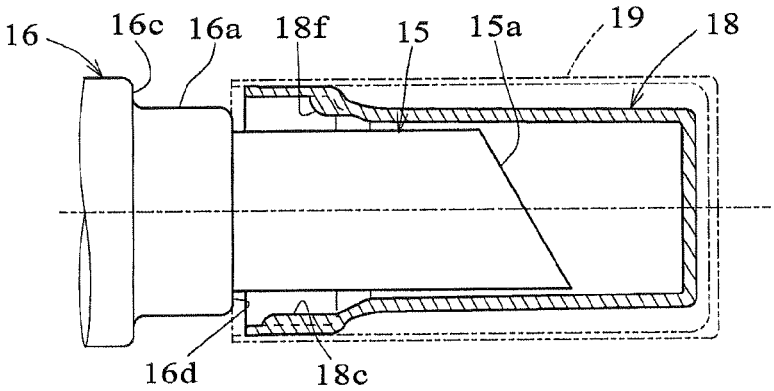
FIGS. 19A to 19D are enlarged longitudinal sectional views of a main part showing a process of covering the cap in the twenty-first embodiment.
Figure 19B:
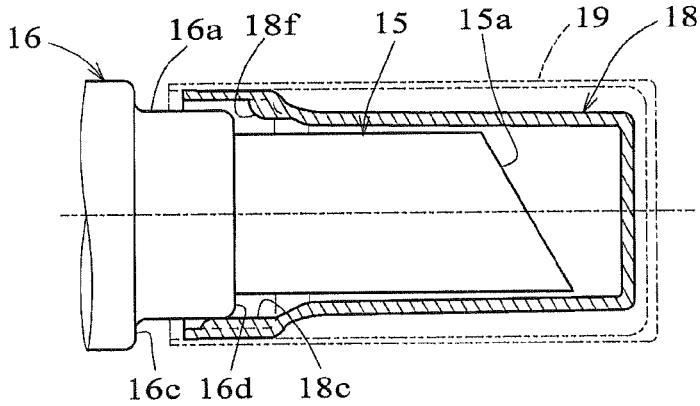
Figure 19C:
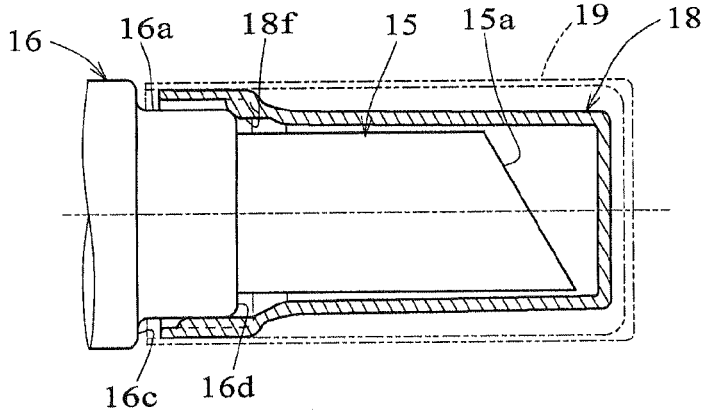
Figure 19D:
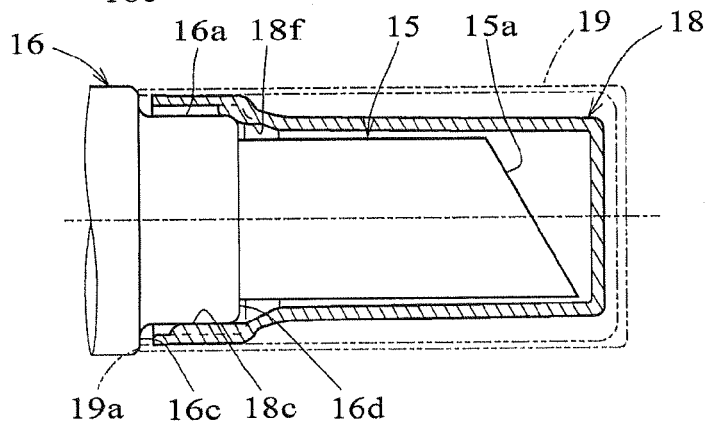

While the container body 14 is covered with the inner cap 18 (see FIG. 19A), an upper end 16*d* of the cross-sectionally smaller square tube 16*a* on the petticoat tube 16 slides into contact with the first protrusion 18*c* on the generally square tube 18*b* of the inner cap 18, with a resultant first slide resistance to the inner cap 18 (see FIG. 19B). While the container body 14 is covered further with the inner cap 18, the generally square tube 18*b* under the first protrusions 18*c* slide resistance slides into contact with the second protrusion 18*f*, with a resultant second slide resistance that is larger than the first slide resistance to the inner cap 18 (see FIG. 19C). The upper end 16*d* moves over the second protrusion 18*f* immediately when a strong covering force is given under the second slide resistance to achieve a fully covering posture against the second slide resistance. Under such a resultant rapid covering, an opening end 19*a* of the cap 17 impacts and abuts against the step 16*c* of the petticoat tube 16. Then, a clicking sound is produced when a fully covering posture is achieved, which is the same as other embodiments of the present disclosure.

A slide resistance is not applied to the cylindrical top tube 18*a*, which is the cross-sectionally smaller tubular portion, because the first and second protrusions 18*c* and 18*f* are formed on the generally square tube 18*b*, which is the cross-sectionally larger tubular portion. The first and second slide resistances are applied to the generally square tube 18*b* at the lower side, which is the cross-sectionally larger tubular portion. A stable covering can be achieved because both of the first and second slide resistances are constantly applied while a slant direction of the gripping cylinder distal end 15*a* is circumferentially different in a positional relationship with respect to the first protrusions 18*c* in the container body 14 where the distal end 15*a* of the gripping cylinder 15 is slanted. Note that a shape and number of the first and second protrusions 18*c* and 18*f* should not be limited in accordance with the twenty-first embodiment as long as the first and second protrusions 18*c* and 18*f* are formed such that the lower end of the first protrusions 18*c* are closer to the opening end 18*e* of the inner cap 18 than the lower end of the second protrusions 18*f*.

Further, a reliable slide resistance can be secured in this embodiment because an expansion deformation of the first and the second protrusions 18*c* and 18*f* can be prevented, the first and second protrusions 18*c* and 18*f* being formed in a vicinity of the corner 18*g* of the generally square tube 18*b*, whose strength is greater than other parts of the inner cap 18.

The first protrusions 18*c* and the second protrusions 18*f* are not necessarily biased to the corners 18*g*, though both of the first protrusions 18*c* and the second protrusions 18*f* are formed in positions biased to corners 18*g* of the generally square tube 18*b* in the twenty-first embodiment. Indeed, another arrangement is possible in a twenty-second embodiment as described below.

Figure 20A:
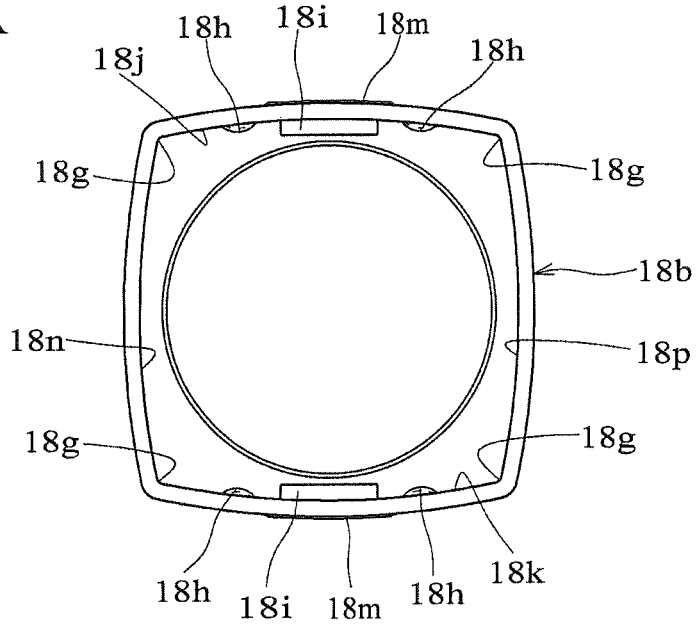
FIG. 20A is a bottom view and FIG. 20B is a longitudinal sectional view, showing a twenty-second embodiment.
Figure 20B:
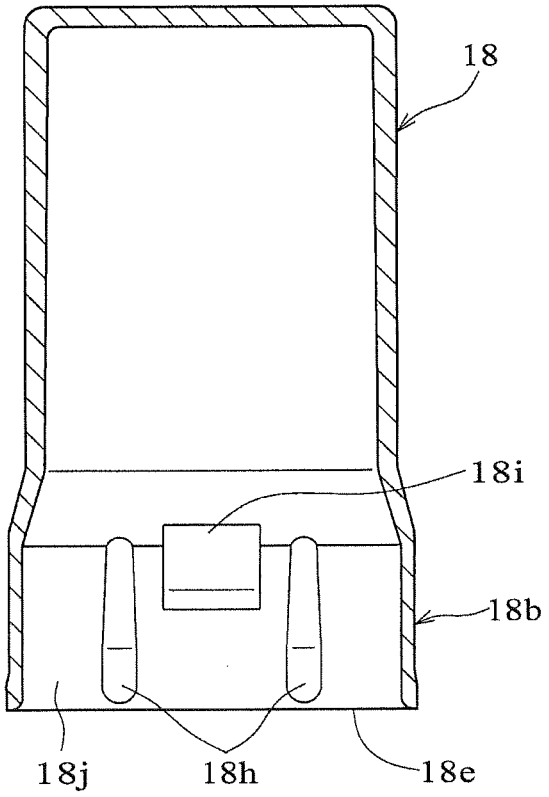

A second protrusion 18*i* that defines a second resistive portion is formed in a central region in a circumferential direction (right and left direction in the drawings) on a surface 18*j* that defines a corner-to-corner portion formed between adjacent corners 18*g* (see FIGS. 20A and 20B). A first protrusion 18*h* is formed in a space between a second protrusion 18*i* and a corner 18*g*, the space being biased to the corner 18*g* rather than a central region of the surface 18*j*. Each of the first protrusions 18*h* is formed to have a lower end that is closer to an opening end 18*e* of an inner cap 18 than the second protrusion 18*i*. Toward an inner side of a generally square tube 18*b*, a projecting amount of the first protrusion 18*h* is less than a projecting amount of the second protrusion 18*i*. Similarly formed is another second protrusion 18*i* on a central region of a surface 18*k* that faces the surface 18*j*. Another first protrusion 18*h* is formed between the second protrusion 18*i* and another corner 18*g*. Accordingly, four first protrusions 18*h* and two second protrusions 18*i* are formed inside of the generally square tube 18*b*. Similar to the aforementioned twenty-first embodiment, the first protrusions 18*h* and the second protrusions 18*i* apply the first and second slide resistances sequentially in a covering course.

Similar to the inner cap 12 of the aforementioned eleventh embodiment, the inner cap 18 of this embodiment includes a tabular reinforcing rib 18*m* that is formed to be a reinforcing portion of the second protrusion 18*i* on an outer surface of the surfaces 18*j* and 18*k* that are formed with the second protrusions 18*i*. Accordingly, a function of the second protrusion 18*i* with a larger slide resistance can be maintained. The reinforcing rib 18*m* prevents the second protrusion 18*i* from losing its capability of returning to an original posture in deformation caused by long-term use, frequent use or use under a high temperature.

Positions for forming the first protrusion 18*h* and the second protrusion 18*i* of the generally square tube 18*b* are not restricted to those positions as in the aforementioned embodiment. Indeed, the second protrusion 18*i* may be formed in a central portion of the surface 18*j* between adjacent corners 18*g* and the first protrusion 18*h* may be formed in a position biased to a corner 18*g*. More specifically, two first protrusions

Figure 21A:
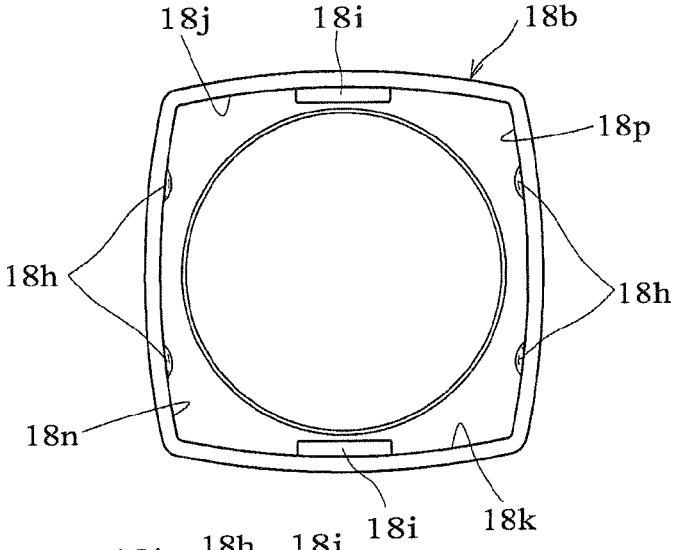
FIGS. 21A, 21B and 21C are bottom views showing twenty-third, twenty-fourth and twenty-fifth embodiments, respectively.

18*h* may respectively be formed on a pair of opposing surfaces 18*n* and 18*p* and one second protrusion 18*i* may respectively be formed on another pair of opposing surfaces 18*j* and 18*k* in a twenty-third embodiment (see FIG. 21A). Accordingly, the first protrusions 18*h* are arranged to face each other, and the second protrusions 18*i* are also arranged to face each other.

Figure 21B:
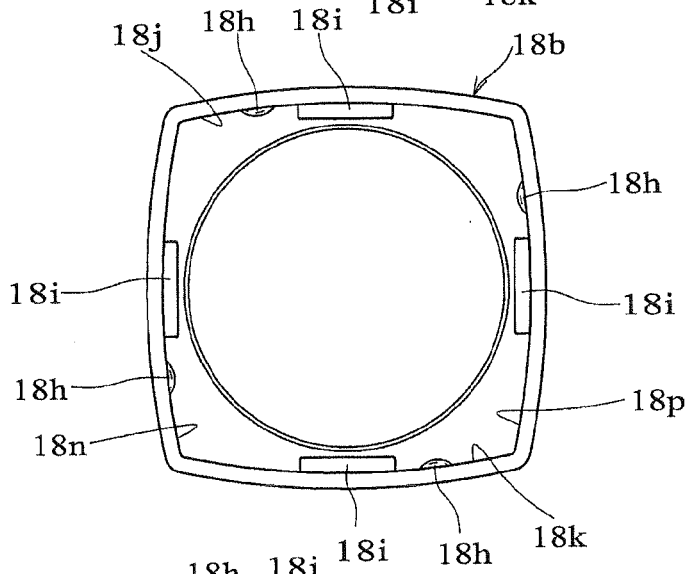

Further, one first protrusion 18*h* and one second protrusion 18*j* may respectively be formed on all of the surfaces 18*j*, 18*n*, 18*k* and 18*p* in a twenty-fourth embodiment (see FIG. 21B). Accordingly, four first protrusions 18*h* are formed to be equiangularly apart.

Figure 21C:
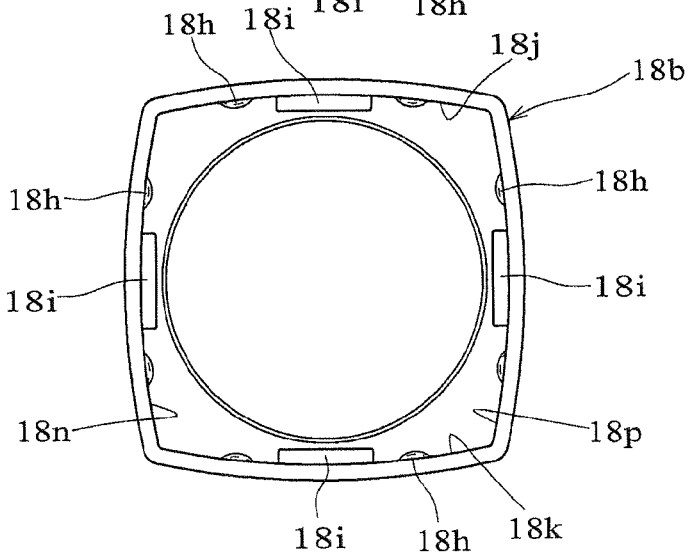

Further, two first protrusions 18*h* and one second protrusion 18*i* may respectively be formed on all of the surfaces 18*j*, 18*n*, 18*k* and 18*p* in a twenty-fifth embodiment (see FIG. 21C). Accordingly, inside of the generally square tube 18*b*, the first protrusions 18*h* are arranged to face each other, and the second protrusions 18*i* are also arranged to face each other.

A container body 14 yields a force to push the first and the second protrusion 18*h* and 18*i* outward in a course of a cap covering when the first and the second protrusions 18*h* and 18*i* are arranged on the pair of opposing surfaces 18*j* and 18*k* while nothing is arranged on another pair of opposing surfaces 18*n* and 18*p* such that no slide resistance can be applied thereto as in the aforementioned twenty-second embodiment. As a result, the surfaces 18*j* and 18*k*, on which the first and the second protrusion 18*h* and 18*i* are formed, may expand out of the generally square tube 18*b*, which in turn causes the surfaces 18*n* and 18*p* to deform inward and stick to the container body 14. Accordingly, a function of the inner cap 18 may worsen in a covering operation.

Figure 22A:
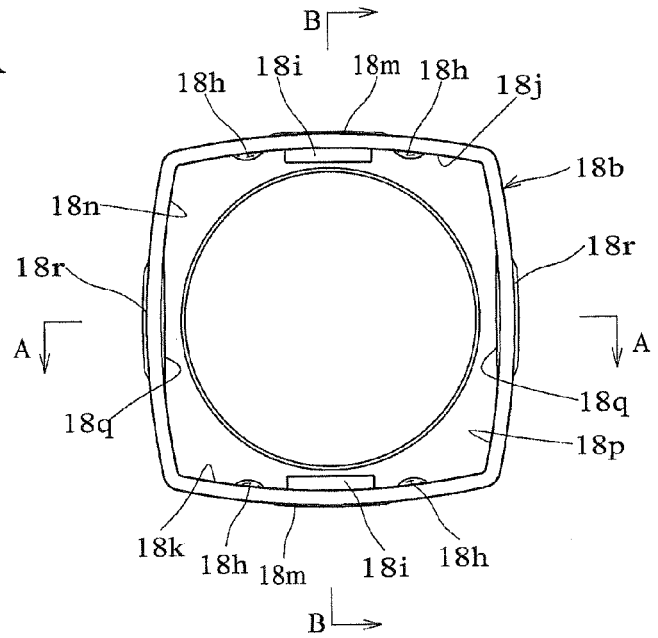
FIG. 22A is a bottom view.
Figure 22B:
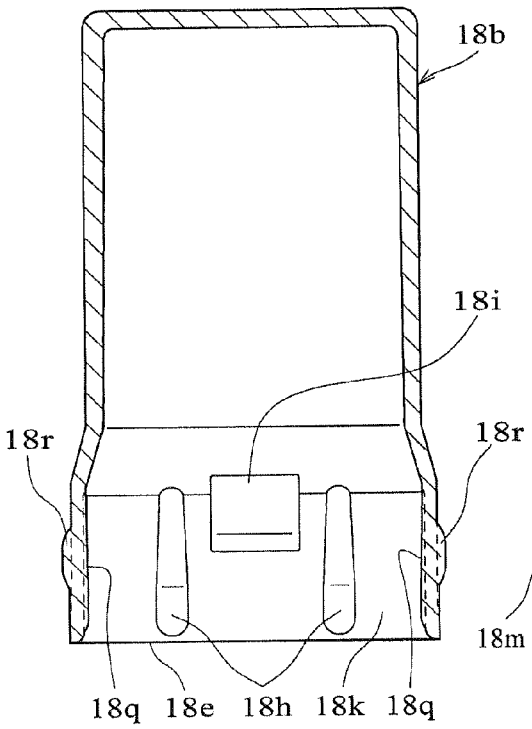
FIG. 22B is a sectional view taken along line A-A and FIG. 22C is a sectional view taken along line B-B, showing a twenty-sixth embodiment.
Figure 22C:
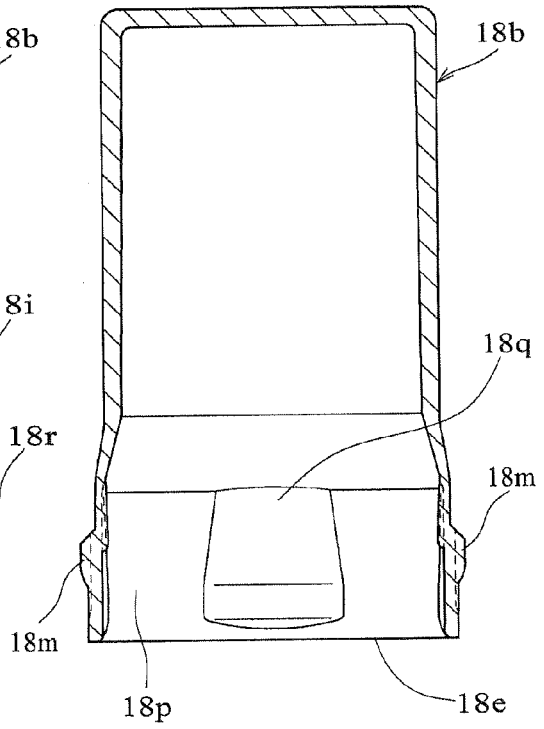

Thus, a third protrusion 18*q* is formed on another pair of surfaces 18*n* and 18*p* so as to project inward of the generally square tube 18*b* when the first and the second protrusions 18*h* and 18*i* are respectively formed on only the pair of surfaces 18*j* and 18*k* in a twenty-sixth embodiment (see FIGS. 22A, 22B and 22C). The third protrusion 18*q* defines a third resistive portion of the present disclosure.

A projecting amount of the third protrusion 18*q* is smaller than the first protrusion 18*h* and the second protrusion 18*i* with respect to an inward direction of the generally square tube 18*b*. A lower end of the third protrusion 18*q* is formed to have a length that is farther from the opening end 18*e* of the inner cap 18 than a lower end of the first protrusion 18*h*. The length of the lower end of the third protrusion 18*q* is also closer to the opening end 18*e* of the inner cap 18 than the lower end of the second protrusion 18*i*.

Because of the above-described the third protrusion 18*q*, it is prevented that the surfaces 18*n* and 18*p* are pulled inward by the surfaces 18*j* and 18*k* so as to completely stick to the container body 14 when the container body 14 presses into sliding contact with the first and the second protrusions 18*h* and 18*i* such that a force is generated to expand the surfaces 18*j* and 18*k* outward. The third protrusion 18*q* slides into contact with the container body 14 and further deformation of the surfaces 18*n* and 18*p* is prevented. Plastic deformation over long-term use can also be prevented so as not to reduce a volume of a clicking sound or eliminate a clicking sound generated at the time of a fully covering posture of the cap 10.

With respect to the container body 14, the first protrusion 18*h* of the inner cap 18 first slides into contact and then the second protrusion 18*i* of the inner cap 18 slides into contact while the inner cap 18 covers the container body 14. In doing so, the third protrusion 18*q* slides into contact with the container body 14 according to deformation of the surfaces 18*n* and 18*p*. As a result, the generally square tube 18*b* can be prevented from expansion deformation that worsens the operation of the cap covering.

In this embodiment, a space S exists between the cap body 11 and a part where the third protrusion 18*q* of the inner cap 18 is formed so as to allow the inner cap 18 to expand or deform. Further, a tabular reinforcing rib 18*r* is formed outside of the generally square tube 18*b* on which the third protrusion 18*q* is formed. Accordingly, the reinforcing rib 18*r* can prevent outward expansion deformation of the surfaces 18*n* and 18*p* in the forming region of the third protrusion 18*q*.

Figure 23A:
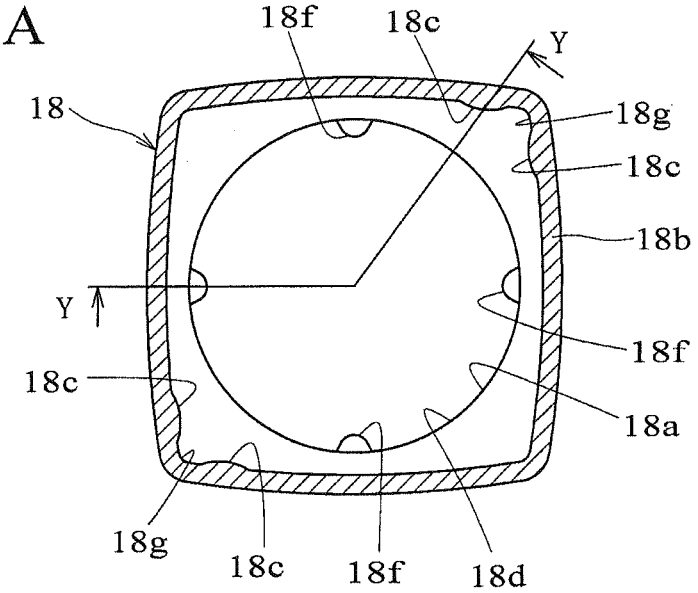
FIGS. 23A and 23B are a bottom sectional view of an inner cap and a side sectional view taken along line Y-Y in a twenty-seven embodiment.
Figure 23B:
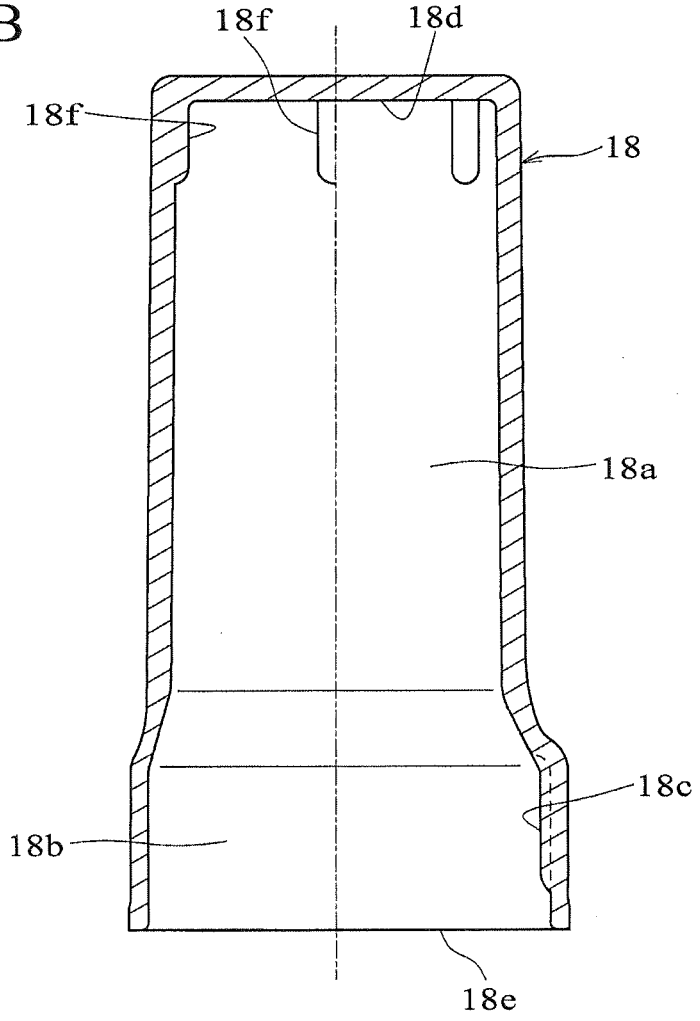

First protrusions 18*c* may be formed on a generally square tube 18*b*, which is a cross-sectionally larger tubular portion, whereas second protrusions 18*f* may be formed on an innermost end 18*d* of a cylindrical top tube 18*a*, which is a cross-sectionally smaller tubular portion in a twenty-seventh embodiment (see FIGS. 23A and 23B). The first protrusions 18*c* are formed to protrude at a pair of corners 18*g* of a generally square tube 18*b* opposed to each other. That is, the first protrusion 18*c* is positioned at each side of the pair of corners 18*g* and biased toward the corners 18*g*. Four second protrusions 18*f* are formed at the innermost end 18*d* of the cylindrical top tube 18*a*. That is, four of the second protrusions 18*f* correspond to intermediate positions between the corners 18*g* of the generally square tube 18*b*. Accordingly, the second protrusions 18*f* have a sufficient projection amount to apply a second slide resistance larger than a slide resistance of the first protrusions 18*c* to the gripping cylinder 15.

A position of the generally square tube 18*b* at which the first protrusions 18*c* are formed and a position of the innermost end 18*d* of the cylinder top tube 18*a* at which the second protrusions 18*f* are formed should not be limited in accordance with the twenty-second embodiment. Specific forming positions and shapes of the first and second protrusions 18*c* and 18*f* may be optional as long as being formed on the generally square tube 18*b* and the innermost end 18*d*, respectively. A number of the first and second protrusions 18*c* and 18*f* also should not be restricted and optional such as two, three, etc.

Figure 24A:
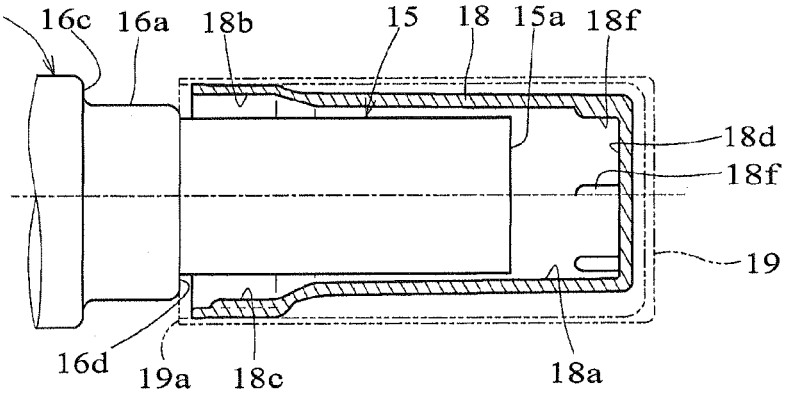
FIGS. 24A to 24D are enlarged longitudinal sectional views of a main part showing a process of covering the cap in the twenty-seven embodiment.
Figure 24B:
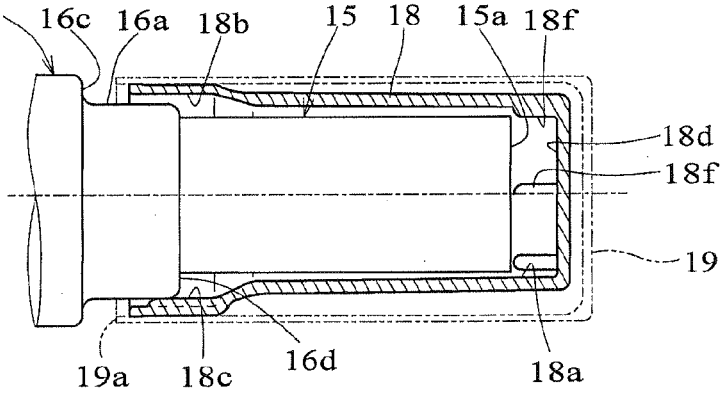
Figure 24C:
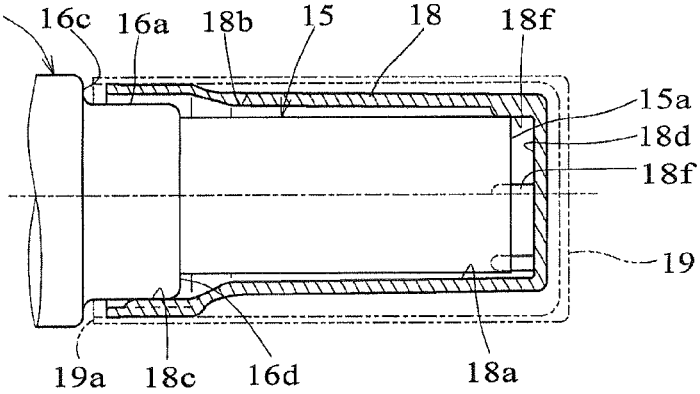
Figure 24D:
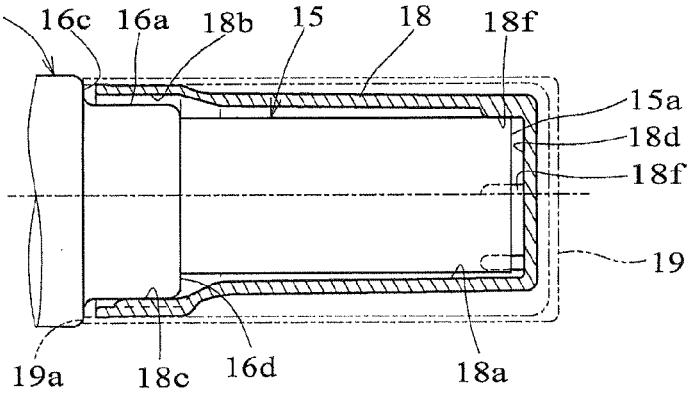

While the covering container body 14 is covered with the inner cap 18 (see FIG. 24A), the cross-sectionally smaller generally square or oblong tube 16*a* of the petticoat tube 16 slides into contact with the first protrusion 18*c* on the generally square tube 18*b* of the inner cap 18, with a resultant first slide resistance to the inner cap 18 (see FIG. 24B). While the covering container body 14 is covered further with the inner cap 18 under the first protrusions 18*c* slide resistance to the petticoat tube 16, the second protrusion 18*f* slides into contact with the distal end 15*a* of the gripping cylinder 15, with a resultant second slide resistance greater than the first slide resistance of the first protrusion 18*c* (see FIG. 24C). When a strong covering force is given under the greater second slide resistance for a fully covering posture, a clicking sound is produced at the time of the fully covering posture (see FIG. 24D), which is the same as other embodiments of the present disclosure.

The above-mentioned configuration of the twenty-second embodiment is not suitable for the case where the distal end 15*a* of the gripping cylinder 15 is slanted. Nevertheless, if the distal end 15*a* is horizontal or normal to the axis of the gripping cylinder 15, the second slide resistance is applied to the horizontal distal end 15*a*. The first resistive portion of the first protrusions 18*c* and the second resistive portion of the second protrusions 18*f* are formed at the upper and lower ends of the inner cap 18. Accordingly, well-balanced resistances can be applied while the container body 1 acquires a superior appearance, similar to the sixteenth embodiment.

The cross-sectionally larger tubular portions of the inner cap 18 and container body 14 should not be limited to generally square or oblong tubes as in the seventeenth to twenty-seventh embodiments. The prevent invention can be carried out by using cross-sectionally larger tubular portions of the inner cap 18 and container body 14 that are formed to be polygonal tubes, such as hexagonal tubes, octagonal tubes and so on. The present invention also can be carried out by using cross-sectionally larger tubular portions that are formed to be circular cylinders. Further, a space can be provided between a position corresponding to the first and second protrusions 18*c* and 18*f* of the inner cap 18 and a cap body 19 in order to form a deformation margin for allowing an expansion deformation of the first and second protrusions 18*c* and 18*f* in the course of the cap covering as in the eleventh embodiment. A reinforcing member also can be provided outside of the inner cap 18 so as to protrude toward the space. The first and second protrusions 18*c* and 18*f* can thus be prevented from being permanently deformed under frequent coverings.

The present disclosure relates to a tubular cosmetic container for storing a column-shaped (stick-shaped) cosmetic such as a lipstick.

1: container body

10: cap

12*b*: first protrusion

12*c*: second protrusion

What is claimed is:

1. A tubular cosmetic container including a container body for accommodating a cylindrical cosmetic and a tubular-topped cap fit outside the container body and provided for covering a to-be-covered portion at an upper side of the container body, the cosmetic container comprising:

a first resistive portion formed on an inner peripheral surface of the cap and configured for applying a first slide resistance by being pressed into sliding contact with the to-be-covered portion from a halfway covering posture to at least an immediately preceding covering posture during a covering of the to-be-covered portion and extending from the halfway covering posture through the immediately preceding covering posture to a fully covering posture;

a second resistive portion formed on the inner peripheral surface of the cap and configured for applying a second slide resistance larger than the first slide resistance by being pressed into sliding contact with the to-be-covered portion from the immediately preceding covering posture to the fully covering posture during the covering of the to-be-covered portion, the second resistive portion having a larger inward projection amount than the first resistive portion so as to have a greater slide resistance than the first resistive portion; and the tubular-topped cap comprises a cap body constituting an outer surface and an inner cap fit inside the cap body and formed with the first and second resistive portions, the first and second resistive portions being formed at an inner peripheral surface of a tubular-topped portion of the inner cap and slid into contact with an outer peripheral surface of a distal end of the to-be-covered portion of the container body, the inner cap includes cross-sectionally smaller and cross-sectionally larger tubular portions respectively located above or below each other, the to-be-covered portion includes cross-sectionally smaller and cross-sectionally larger tubular portions respectively located above or below each other, the to-be-covered portion can be covered with the inner cap, the cross-sectionally smaller tubular portion of the inner cap is formed with the first resistive portion to be slid into contact with the cross-sectionally smaller tubular portion of the to-be-covered portion, and the cross-sectionally larger tubular portion of the inner cap is formed with the second resistive portion to be slid into contact with the cross-sectionally larger tubular portion of the to-be-covered portion.

2. A tubular cosmetic container including a container body for accommodating a cylindrical cosmetic and a tubular-topped cap fit outside the container body and provided for covering a to-be-covered portion at an upper side of the container body, the cosmetic container comprising:

a first resistive portion formed on an inner peripheral surface of the cap and configured for applying a first slide resistance by being pressed into sliding contact with the to-be-covered portion from a halfway covering posture to at least an immediately preceding covering posture during a covering of the to-be-covered portion and extending from the halfway covering posture through the immediately preceding covering posture to a fully covering posture; and a second resistive portion formed on the inner peripheral surface of the cap and configured for applying a second slide resistance larger than the first slide resistance by being pressed into sliding contact with the to-be-covered portion from the immediately preceding covering posture to the fully covering posture during the covering of the to-be-covered portion, the cap including a cap body with an outer surface and an inner cap fit inside the cap body and formed with the first and second resistive portions, wherein a reinforcement is formed on a part of the inner cap on which at least the second resistive portion is formed, the reinforcement being configured for reinforcing the second resistive portion.

3. The cosmetic container according to claim 2, wherein the second resistive portion has a larger inward projection amount than the first resistive portion so as to have a greater slide resistance than the first resistive portion.

4. The cosmetic container of claim 3, wherein the first and second resistive portions are formed at an inner peripheral surface of a tubular-topped portion of the inner cap and slid into contact with an outer peripheral surface of a distal end of the to-be-covered portion of the container body.

5. The cosmetic container according to claim 4, wherein:

the inner cap includes cross-sectionally smaller and cross-sectionally larger tubular portions respectively located above or below each other, the to-be-covered portion includes cross-sectionally smaller and cross-sectionally larger tubular portions respectively located above or below each other, the to-be-covered portion can be covered with the inner cap, the cross-sectionally smaller tubular portion of the inner cap is formed with the first resistive portion to be slid into contact with the cross-sectionally smaller tubular portion of the to-be-covered portion, and the cross-sectionally larger tubular portion of the inner cap is formed with the second resistive portion to be slid into contact with the cross-sectionally larger tubular portion of the to-be-covered portion.

6. A tubular cosmetic container including a container body for accommodating a cylindrical cosmetic and a tubular-topped cap fit outside the container body and provided for covering a to-be-covered portion at an upper side of the container body, the cosmetic container comprising:

a first resistive portion formed on an inner peripheral surface of the cap and configured for applying a first slide resistance by being pressed into sliding contact with the to-be-covered portion from a halfway covering posture to at least an immediately preceding covering posture during a covering of the to-be-covered portion and extending from the halfway covering posture through the immediately preceding covering posture to a fully covering posture;

a second resistive portion formed on the inner peripheral surface of the cap and configured for applying a second slide resistance larger than the first slide resistance by being pressed into sliding contact with the to-be-covered portion from the immediately preceding covering posture to the fully covering posture during the covering of the to-be-covered portion, wherein:

the tubular-topped cap comprises a cap body constituting an outer surface and an inner cap fit inside the cap body and formed with the first and second resistive portions, the inner cap includes cross-sectionally smaller and cross-sectionally larger tubular portions respectively located above or below with each other, the to-be-covered portion includes cross-sectionally smaller and cross-sectionally larger tubular portions respectively located above or below with each other, the to-be-covered portion can be covered with the inner cap, and the cross-sectionally larger tubular portion of the inner cap is formed with the first and second resistive portions to be slid into contact with the cross-sectionally larger tubular portion of the to-be-covered portion.

7. A tubular cosmetic container including a container body for accommodating a cylindrical cosmetic and a tubular-topped cap fit outside the container body and provided for covering a to-be-covered portion at an upper side of the container body, the cosmetic container comprising:

a first resistive portion formed on an inner peripheral surface of the cap and configured for applying a first slide resistance by being pressed into sliding contact with the to-be-covered portion from a halfway covering posture to at least an immediately preceding covering posture during a covering of the to-be-covered portion and extending from the halfway covering posture through the immediately preceding covering posture to a fully covering posture;

a second resistive portion formed on the inner peripheral surface of the cap and configured for applying a second slide resistance larger than the first slide resistance by being pressed into sliding contact with the to-be-covered portion from the immediately preceding covering posture to the fully covering posture during the covering of the to-be-covered portion, wherein:

the tubular-topped cap comprises a cap body constituting an outer surface and an inner cap fit inside the cap body and formed with the first and second resistive portions, the inner cap includes cross-sectionally smaller and cross-sectionally larger tubular portions respectively located above or below with each other, the to-be-covered portion includes cross-sectionally smaller and cross-sectionally larger tubular portions respectively located above or below with each other, the to-be-covered portion can be covered with the inner cap, the cross-sectionally larger tubular portion of the inner cap is formed with the first resistive portion to be slid into contact with the cross-sectionally larger tubular portion of the to-be-covered portion, the cross-sectionally smaller tubular portion of the inner cap is formed with the second resistive portion to be slid into contact with the cross-sectionally smaller tubular portion of the to-be-covered portion.

8. The cosmetic container according to claim 6, wherein each of the cross-sectionally smaller and cross-sectionally larger tubular portions of the inner cap and the to-be-covered portion is a circular cylinder.

9. The cosmetic container according to claim 6, wherein the cross-sectionally smaller tubular portions of the inner cap and the to-be-covered portion are circular cylinders, and the cross-sectionally larger tubular portions of the inner cap and the to-be-covered portion are non-cylindrical tubes.

10. The cosmetic container according to claim 9, wherein at least one of the first resistive portion and the second resistive portion is formed in a position that is biased to a corner of the non-cylindrical tubes.

11. The cosmetic container according to claim 9, wherein at least one of a pair of the first resistive portions and a pair of the second resistive portions are formed at sides of the corner of the non-cylindrical tubes.

12. The cosmetic container according to claim 10, wherein the non-cylindrical tubes are oblong or square tubes, and the corner to which the first resistive portions or the second resistive portions are biased is at least a pair of corners that are diagonally located to each other.

13. The cosmetic container according to claim 9, wherein the first resistive portion is formed in a position biased to a corner of the non-cylindrical tube, and the second resistive portion is formed in a central region positioned between adjacent corners of the non-cylindrical tube.

14. The cosmetic container according to claim 13, wherein the first resistive portion and the second resistive portion are formed at regions between same adjacent corners, and the first resistive portion is formed between the second resistive portion and one of the corners.

15. The cosmetic container according to claim 14, wherein the non-cylindrical tubes are oblong or square tubes, and the regions between the adjacent corners on which the first resistive portion and the second resistive portion are formed are positioned at, at least, a pair of opposing surfaces.

16. The cosmetic container according claim 6, wherein a space exists between the cap body and a part on which at least one of the first resistive portion and the second resistive portion of the inner cap are formed, the space defining a deformation margin for allowing the inner cap to deform as the container body presses into sliding contact with at least one of the first resistive portion and the second resistive portion of the inner cap.

17. The cosmetic container of claim 2, wherein the reinforcement includes a part from which the second resistive portion protrudes so as to secure a deformation margin of at least the second resistive portion.

18. A tubular cosmetic container including a container body for accommodating a cylindrical cosmetic and a tubular-topped cap fit outside the container body and provided for covering a to-be-covered portion at an upper side of the container body, the cap including a cap body with an outer surface and an inner cap fit inside the cap body, the cosmetic container comprising:

a first resistive portion formed on an inner peripheral surface of the cap and configured for applying a first slide resistance by being pressed into sliding contact with the to-be-covered portion from a halfway covering posture to at least an immediately preceding covering posture during a covering of the to-be-covered portion and extending from the halfway covering posture through the immediately preceding covering posture to a fully covering posture;

a second resistive portion formed on the inner peripheral surface of the cap and configured for applying a second slide resistance larger than the first slide resistance by being pressed into sliding contact with the to-be-covered portion from the immediately preceding covering posture to the fully covering posture during the covering of the to-be-covered portion; and a third resistive portion between the first resistive portion and the second resistive portion, the to-be-covered portion sliding into contact with the third resistive portion in the course of covering the to-be-covered portion, wherein a space exists between the cap body and a part on which the third resistive portion of the inner cap is formed, the space defining a deformation margin for allowing the inner cap to deform as the container body slides into contact with the third resistive portion.

19. The cosmetic container according to claim 18, wherein a reinforcement is formed on a part of the inner cap on which the third resistive portion is formed, the reinforcement being configured for reinforcing the third resistive portion.

* * * * *